US006677923B2

(12) United States Patent
Kajihara et al.

(10) Patent No.: US 6,677,923 B2
(45) Date of Patent: Jan. 13, 2004

(54) LIQUID CRYSTAL DRIVER AND LIQUID CRYSTAL DISPLAY INCORPORATING THE SAME

(75) Inventors: Noriyuki Kajihara, Nara (JP); Yoshinori Ogawa, Yamatotakada (JP)

(73) Assignee: Sharp Kabushiki Kaisha, Osaka (JP)

( * ) Notice: Subject to any disclaimer, the term of this patent is extended or adjusted under 35 U.S.C. 154(b) by 270 days.

(21) Appl. No.: 09/964,572

(22) Filed: Sep. 28, 2001

(65) Prior Publication Data

US 2002/0036609 A1 Mar. 28, 2002

(30) Foreign Application Priority Data

Sep. 28, 2000 (JP) ..... 2000-297529
Jul. 3, 2001 (JP) ..... 2001-202539

(51) Int. Cl.[7] ..... G09G 3/36
(52) U.S. Cl. ..... 345/89; 345/93; 345/211
(58) Field of Search ..... 345/87, 89, 90, 345/93, 98, 100, 211

(56) References Cited

U.S. PATENT DOCUMENTS 5,119,086 A * 6/1992 Nishioka et al. ..... 345/690
5,854,627 A * 12/1998 Kurihara et al. ..... 345/211
5,973,660 A * 10/1999 Hashimoto ..... 345/98
6,188,395 B1 * 2/2001 Yatabe ..... 345/211
6,239,781 B1 * 5/2001 Fujisawa ..... 345/691
6,275,209 B1 * 8/2001 Yamamoto ..... 345/95
6,538,630 B1 * 3/2003 Tanaka et al. ..... 345/94

FOREIGN PATENT DOCUMENTS

JP 2000-047625 2/2000

* cited by examiner

*Primary Examiner*—Richard Hjerpe
*Assistant Examiner*—Duc Q Dinh
(74) *Attorney, Agent, or Firm*—Birch, Stewart, Kolasch & Birch, LLP

(57) ABSTRACT

The present invention includes:

standard voltage producing means for producing $2^n$ tone display voltages from incoming first reference voltages in accordance with n-bit display data; and selecting means for selecting a voltage from the $2^n$ tone display voltages in accordance with incoming display data, for transmission to a liquid crystal panel through a plurality of output terminals with no further processing, wherein the standard voltage producing means includes:

generation means for generating a second reference voltage from adjacent two of the first reference voltages arranged in ascending or descending order, the second reference voltage having an intermediate level between those of the adjacent first reference voltages;

buffer means for impedance-converting the second reference voltage for output; and voltage dividing means for producing a voltage having an intermediate level between those of the adjacent first reference voltages and of adjacent ones of the first and second reference voltages by voltage division, so as to produce the $2^n$ tone display voltages.

12 Claims, 16 Drawing Sheets

LIQUID CRYSTAL DRIVER AND LIQUID CRYSTAL DISPLAY INCORPORATING THE SAME

FIELD OF THE INVENTION

The present invention relates to liquid crystal drivers for driving a liquid crystal panel (liquid crystal display section) and liquid crystal displays including the driver, in particular to liquid crystal drivers that are small in size and low in power consumption and liquid crystal displays including the driver.

BACKGROUND OF THE INVENTION

Referring to FIG. 9, a block diagram is shown depicting a thin film transistor (TFT) liquid crystal display, which is a typical example of active matrix liquid crystal displays.

The liquid crystal display includes a liquid crystal display section and a liquid crystal driver driving the display section. The liquid crystal display section is made based on a TFT liquid crystal panel 901 in which there are provided a liquid crystal display element (not shown) and an opposite electrode (common electrode) 906.

Meanwhile, the liquid crystal driver is formed by IC-based source drivers 902, IC-based gate drivers 903, a controller 904, and a liquid crystal power supply 905.

Each of the source drivers 902 and the gate drivers 903 is typically fabricated from an IC (Integrated Circuit) chip placed on a wired film, such as a tape carrier package (TCP). The mounting of the IC chip on a liquid crystal panel is done by connecting the IC chip to the ITO (Indium Tin Oxide) terminals of the liquid crystal panel or by direct thermo-compression of the IC chip to the ITO terminals with an intervening anisotropic conductive film (ACF).

In some cases, the controller 904, liquid crystal power supply 905, source drivers 902, and gate drivers 903 are entirely or partly integrated on a single chip to fit in a reduced size of the liquid crystal display. FIG. 9 shows these components individually according to their functions.

The controller 904 supplies digitized display data (for example, RGB signals corresponding to red, green, and blue) and various control signals to the source drivers 902 and gate drivers 903. Major control signals supplied to the source drivers 902 include a horizontal synchronizing signal, a start pulse signal, and a source driver clock signal which are indicated as S1 in the diagram. Major control signals supplied to the gate drivers 903 include a vertical synchronizing signal and a gate driver clock signal which are indicated as S2 in the diagram. The power source to drive the ICs are omitted in the diagram.

The liquid crystal power supply 905 supplies a liquid crystal panel display voltage (more specifically, in the present invention, a reference voltage from which tone display voltages are produced) to the source drivers 902 and gate drivers 903.

The controller 904, receiving the display data from a member not shown in the diagram, transmits the data to the source drivers 902 in the form of a digital signal as the display data D. Each source driver 902 latches the incoming digital display data serially and subsequently converts the latched data from digital to analog based on the incoming horizontal synchronizing signal (alternatively referred to as latch signal Ls as shown in FIG. 13). The source driver 902 then supplies the D/A converted data, i.e., the analog voltage for tone displays (tone display voltage), from its liquid crystal drive voltage output terminal over a later-detailed source signal line 1004 to an associated liquid crystal display element (not shown) in the liquid crystal panel 901.

Now, the liquid crystal panel 901 will be described. FIG. 10 shows the structure of the liquid crystal panel 901. The liquid crystal panel 901 is provided with pixel electrodes 1001, pixel capacitors 1002, TFTs 1003 for turning on/off the application of voltages to the respective pixels, source signal lines 1004, gate signal lines 1005, and an opposite electrode 1006 (an equivalent to the opposite electrode 906 in FIG. 9). In the figure, the region identified as "A" encloses liquid crystal display elements for one pixel.

The source signal lines 1004 are fed from the source drivers 902 with tone display voltages according to the brightness of the pixels required for a display. The gate signal lines 1005 are fed from the gate drivers 903 with scan signals to sequentially turn on the TFTs 1003 row by row. As the scan signal turns on the TFT 1003, permitting a voltage to be applied through the source signal line 1004 to the pixel electrode 1001 connected to the drain of the TFT 1003, the pixel capacitor 1002 between the pixel electrode 1001 and the opposite electrode 1006 is charged. This changes the transmittance of the liquid crystal to visible light, effecting a display.

FIGS. 11 and 12 show an example of a liquid crystal drive waveform. In the figures, 1101 and 1201 identify a drive signal output from the source driver 902; 1102 and 1202 a drive signal output from the gate driver 903; 1103 and 1203 the potential of the opposite electrode 1006; and 1104 and 1204 the potential of the pixel electrode 1001. The voltage across the liquid crystal material is equal to the potential difference between the pixel electrode 1001 and the opposite electrode 1006, which is shown by slant lines in the figure.

For example, in FIG. 11, the TFT 1003 is on when the drive signal output 1102 from the gate driver 903 is high, causing the difference between the drive signal output 1101 from the source driver 902 and the potential 1103 of the opposite electrode 1006 to be applied to the pixel electrode 1001. The drive signal output 1102 from the gate driver 903 subsequently goes LOW. This turns off the TFT 1003, but does not change the foregoing voltage applied to the pixel due to the provision of the pixel capacitor 1002. The same description holds true with the case of FIG. 12.

FIGS. 11 and 12 show cases of different voltages being applied to the liquid crystal material. A higher voltage is applied in the case of FIG. 11 than in the case of FIG. 12. The voltage across the liquid crystal, when varied in an analog manner as above, causes the transmittance of the liquid crystal to light to vary in an analog manner; a tone display is thus produced. The number of displayed tones is determined by the number of analog voltages available for application to the liquid crystal.

The present invention is directed to standard voltage generator circuits and output circuits for use in tone display circuits that are very large in size and very high in power consumption. For these reasons, the following will describe the liquid crystal driver with a focus on the source drivers 902.

FIG. 13 is a block diagram of the source drivers 902. Description will be made below about major components only. Digital display data sets DR, DG, DB (for example, 6 bits), as transmitted from the controller 904, are temporarily latched by an input latch circuit 1301. The digital display data sets DR, DG, DB correspond to red, green, and blue respectively.

Meanwhile, a start pulse signal SP is shifted through a shift register circuit 1302 in synchronism with the clock signal CK and appears at the last stage of the shift register circuit 1302, from which the start pulse signal SP (cascade output signal S) is supplied to a next source driver.

The digital display data sets DR, DG, DB latched by the input latch circuit 1301 are temporarily stored serially in the sampling memory circuit 1303 in synchronism with output signals from a number of stages of the shift register circuit 1302 and transmitted to a hold memory circuit 1304 in the next stage.

As display data for one horizontal synchronization period is stored in the sampling memory circuit 1303, the hold memory circuit 1304 acquires an output signal from the sampling memory circuit 1303 based on the horizontal synchronizing signal (latch signal Ls) to supply to a level shifter circuit 1305 in the next stage and to retain the display data until an input of a succeeding horizontal synchronizing signal.

The level shifter circuit 1305 boosts or otherwise changes a signal level so that the signal is suitable to a D/A converter circuit 1306, in the next stage, which processes the level of a voltage applied to the liquid crystal panel. The standard voltage generator circuit 1309 produces analog voltages from a reference voltage VR fed from the aforementioned liquid crystal power supply 905 (see FIG. 9) for outputs to the D/A converter circuit 1306 to effect a tone display.

The D/A converter circuit 1306 chooses, from the analog voltages supplied from the standard voltage generator circuit 1309, an analog voltage suitable to the display data of which the level is shifted by the level shifter circuit 1305. The analog voltage representative of a display tone is transmitted to an output circuit 1307 from which the analog voltage leaves through liquid crystal drive voltage output terminals (hereinafter, output terminals) 1308 for source signal lines in the liquid crystal panel 901. The output circuit 1307 is basically a buffer circuit and is formed by, for example, a voltage follower circuit including a differential amplifier circuit.

Now, the standard voltage generator circuit 1309 and the D/A converter circuit 1306, which are the core of the present invention, will be described in more detail in terms of their circuit structure.

FIG. 14 shows, as an example, a circuit structure of the standard voltage generator circuit 1309. When each R, G, B digital display data set consists of, for example, 6 bits, the standard voltage generator circuit 1309 produces 64 analog voltages that correspond to $2^6$ (=64) display tones for output. The structure is now described more specifically.

The standard voltage generator circuit 1309 includes a resistance divider circuit formed by resistors $R_0$–$R_7$ connected in series, a very simple configuration. Each resistor $R_0$–$R_7$ is formed by eight resistor elements connected in series: for example, referring to FIG. 15, the resistor $R_0$ is formed by eight resistor elements $R_{01}$, $R_{02}$, . . . and $R_{08}$ connected in series. The remaining resistors $R_1$–$R_7$ have an identical configuration to the resistor $R_0$. So, the standard voltage generator circuit 1309 as a whole includes 64 resistor elements connected in series.

The standard voltage generator circuit 1309 has nine halftone voltage input terminals corresponding to the nine reference voltages $V'_0$, $V'_8$, . . . , $V'_{56}$, and $V'_{64}$. The resistor $R_0$ is connected at an end thereof to a halftone voltage input terminal for to the reference voltage $V'_{64}$ and at the other end, i.e., the contact of the resistors $R_0$ and $R_1$, to a halftone voltage input terminal for the reference voltage $V'_{56}$. Likewise, the contacts of the adjacent resistors $R_1$ and $R_2$, $R_2$ and $R_3$, . . . , $R_6$ and $R_7$ are connected to respective halftone voltage input terminals corresponding to the reference voltages $V'_{48}$, $V'_{40}$, . . . $V'_8$. A halftone voltage input terminal for the reference voltage $V'_0$ is connected to one of the ends of the resistor $R_7$ at which the resistor $R_6$ is not connected.

The configuration enables voltages $V_1$–$V_{63}$ to be picked up at the contacts between the 64 resistor elements. The voltages $V_1$–$V_{63}$, plus a voltage $V_0$ coming straight from the reference voltage $V'_0$, provide 64 different analog voltages ($V_0$–$V_{63}$) for a tone display. In short, if the standard voltage generator circuit 1309 is formed by the resistance divider circuit, the resistance ratios determines the analog voltages $V_0$–$V_{63}$ for use to produce a tone display. The 64 analog voltages $V_0$–$V_{63}$ are fed from the standard voltage generator circuit 1309 to the D/A converter circuit 1306.

Typically, the two reference voltages $V'_0$ and $V'_{64}$ derived at the ends are always coupled to the halftone voltage input terminals. The seven halftone voltage input terminals for the remaining voltages $V'_8$–$V'_{56}$ are used for fine adjustment and may in some cases receive no voltages at all.

Now, the D/A converter circuit 1306 will be described. FIG. 16 shows the structure of the D/A converter circuit 1306 as an example. In the figure, 1307 is the structure (voltage follower circuit) of the output circuit described above.

MOS transistors and transmission gates are arranged as analog switches in the D/A converter circuit 1306 so that one of the 64 input voltages $V_0$–$V_{63}$ is selected for output according to display data represented by a 6-bit digital signal, that is, the switches are turned on/off according to the display data (Bit 0 to Bit 5) represented by a 6-bit digital signal. As a result, a voltage is selected from the 64 input voltages for an output to the output circuit 1307. The process will be described in more detail below.

The 6-bit digital signal gives Bit 0 as the least significant bit (LSB) and Bit 5 as the most significant bit (MSB). The switches are arranged in pairs. 32 pairs of switches (or 64 switches) correspond to Bit 0 and 16 pairs of switches (or 32 switches) correspond to Bit 1. The number of (pairs of) switches halves for each subsequent bit. That leaves a single pair of switches (or two switch) corresponding to Bit 5. Thus, the D/A converter circuit 1306 includes $2^5+2^4+2^3+2^2+2^1+1=63$ pairs of switches (or 126 switches).

An end of each switch for Bit 0 has a terminal to which one of the voltages $V_0$–$V_{63}$ is coupled. The other end is connected to an end of another switch, and the two ends are both connected together to an end of a switch for next Bit 1. The same arrangement is repeated for every switch corresponding to Bit 0 to Bit 5. That leaves a single line extended from the switch corresponding to Bit 5 and connected to the output circuit 1307.

The switches for Bit 0 to Bit 5 will be referred to as switch groups $SW_0$ to $SW_5$. The switches in the switch groups $SW_0$ to $SW_5$ are controlled by 6-bit digital display data (Bit 0 to Bit 5) as will be described in the following.

The switch groups $SW_0$ to $SW_5$ behave so that one of the paired analog switches (the lower one of the paired switches in the diagram) is on when the corresponding bit is 0 (LOW) and the other of the paired analog switches (the upper one in the diagram) is on when the corresponding bit is 1 (HIGH). The diagram shows Bit 0 to Bit 5 (111111): the upper switch of every pair is on and the lower switch is off. In this situation, the D/A converter circuit 1306 supplies the voltage $V_{63}$ to the output circuit 1307.

Likewise, for example, when Bit 5 to Bit 0 are (111110), (000001), and (000000), the D/A converter circuit 1306 supplies the voltages $V_{62}$, $V_1$, and $V_0$ respectively to the output circuit 1307. A voltage is selected in this manner from the tone display analog voltages $V_0$–$V_{63}$ in accordance with a digital display to produce a tone display.

Typically, each source driver IC includes only one standard voltage generator circuit 1309 for common use among the output terminals 1308. A D/A converter circuit 1306 and an output circuit 1307 are however provided to each output terminal 1308.

To produce a color display, different colors require different sets of output terminals 1308. In that situation, a D/A converter circuit 1306 and an output circuit 1307 are provided to each pixel and each color. In other words, suppose that the liquid crystal panel 901 has N pixels along the width, the liquid crystal panel 901 requires N output terminals 1308 for each color and hence includes 3N D/A converter circuits 1306 and 3N output circuits 1307 in all. The output terminals 1308 are denoted as $R_1$, $G_1$, $B_1$; $R_2$, $G_2$, $B_2$; . . . and; $R_N$, $G_N$, $B_N$, where R, G, B stand for red, green, and blue, and the subscript n (n=1, 2, . . . , N) denotes each pixel.

In practical use, to produce a naturally looking tone image on a liquid crystal display, a gamma correction is carried out for adjustment of light transmission characteristics of the liquid crystal material in consideration of human vision. The gamma correction is implemented by the standard voltage generator circuit 1309 producing various tone display analog voltages through unequal division of the internal resistance, not through equal division thereof.

FIG. 17 shows the relationship between tone display data (digital display data) and a liquid crystal drive output voltage (tone display analog voltage) with gamma correction applied. As is observable in the figure, the tone display analog voltage is adapted so that the relationship thereof with digital display data is represented by a zigzag line.

To actually impart such properties to the tone display analog voltage, in the standard voltage generator circuit 1309 of FIG. 14, the resistors $R_0$–$R_7$ are adapted to exhibit such resistance values that can effect the gamma correction and each resistor $R_0$–$R_7$ is divided to eight elements with an identical resistance. In other words, the eight resistor elements $R_{01}$, $R_{02}$, . . . $R_{08}$ connected in series (collectively termed "the resistor $R_0$") have an identical resistance, and the resistors $R_0$, $R_1$, . . . $R_7$, each of which is formed by eight series resistor elements, have a ratio of resistances that can effect the gamma correction. The gamma correction is effected this way.

The description above is made about drivers to produce a tone image on a TFT liquid crystal display.

Incidentally, research and development on liquid crystal displays were conventionally centered around demands to increase the screen size for application to television sets, computer displays, and the like. Conversely, today's demands are shifting to liquid crystal displays and liquid crystal drivers suited for application to portable displays in portable phones and other like devices that are creating a rapidly growing market.

The screen size suitable for adoption in portable devices is basically small. Accordingly, it is strongly required that the liquid crystal display and driver be small, lightweight, and energy efficient (because they rely on battery for operational power), and inexpensive.

Circuitry to produce the aforementioned, conventional tone display works in the following manner: A standard voltage generator circuit formed by resistor circuits connected in series generates number of analog voltages for output. The outputs are coupled to a D/A converter circuit including analog switch circuits where the analog switches select one of the incoming voltages according to digital display data. The output circuit (voltage follower circuit) then transmits the selected analog voltage as a tone display liquid crystal drive voltage. Among these components, the voltage follower circuit occupies a large portion of the circuit area and consumes a lot of electric power, because the circuit is an analog circuit including a differential amplifier circuit.

In a conventional display for large screens, source signal lines and pixels of the liquid crystal panel have large load capacity. A voltage follower circuit and other buffer circuits were therefore essential as part of an output circuit to charge and discharge the pixel and the source signal line capacitor and provide a predetermined drive voltage free from waveform distortion (rounding). For these reasons, each output terminal is provided with its own voltage follower circuit despite large current consumption.

The display of a portable device has a small screen size and pixel area, which does not require strict specifications on resolution. Therefore, medium to small size liquid crystal displays with about 560×240 pixels are often used, so the pixel and the source signal line have a small load capacity. This indicates that the output stage no longer must have much driving capability.

For these reasons, the highly current-consuming output circuit (voltage follower circuit) is omitted in the display for use in portable devices. Under these conditions, a standard voltage generator circuit formed by resistor circuits connected in series generates a number of analog voltages for output. The outputs are coupled to a D/A converter circuit including analog switch circuits where the analog switches select one of the incoming voltages according to digital display data and directly transmit the selected analog voltage as a tone display liquid crystal drive voltage.

A problem arises from the fact that tone display analog voltages are supplied to the liquid crystal panel through resistors in the standard voltage generator circuit. A downside of this technique is that the liquid crystal drive voltage waveform is rounded at rises and falls, because of charging/discharging of the pixel and source signal line capacitor of the liquid crystal panel.

SUMMARY OF THE INVENTION

The present invention, in view of the foregoing problems, has an objective to offer a liquid crystal driver capable of preventing distortion of a drive waveform without providing an output circuit in each output terminal to the liquid crystal panel and thus reducing the size of the liquid crystal display sufficiently for use in a compact, low power consuming portable devices, and also to offer a liquid crystal display including such a liquid crystal driver.

In order to achieve the objective, a liquid crystal driver in accordance with the present invention is a liquid crystal driver including:

standard voltage producing means for producing $2^n$ tone display voltages from incoming first reference voltages in accordance with n-bit display data; and selecting means for selecting a voltage from the $2^n$ tone display voltages in accordance with incoming display data, for transmission to a liquid crystal panel through a plurality of output terminals with no further processing, and is characterized in that the standard voltage producing means includes:

generation means for generating a second reference voltage from adjacent two of the first reference voltages arranged in ascending or descending order, the second reference voltage having an intermediate level between those of the adjacent first reference voltages;

buffer means for impedance-converting the second reference voltage for output; and voltage dividing means for producing a voltage having an intermediate level between those of the adjacent first reference voltages and of adjacent ones of the first and second reference voltages by voltage division, so as to produce the $2^n$ tone display voltages.

By adopting this arrangement, the selecting means selects, in accordance with incoming display data, a voltage from the $2^n$ tone display voltage produced by the standard voltage producing means, for transmission to the liquid crystal panel through a plurality of output terminals with no further processing.

Here, in the standard voltage producing means, the generation means generates a second reference voltage from adjacent two of the incoming first reference voltages arranged in ascending or descending order, the second reference voltage having an intermediate level between those of the adjacent first reference voltages. The second reference voltage is impedance-converted by the buffer means, and its waveform distortion is reduced as a result. The second reference voltage is supplied to the voltage dividing means with reduced waveform distortion. The voltage dividing means produces a voltage having an intermediate level between those of the adjacent first reference voltages and of adjacent ones of the first and second reference voltages by voltage division, so as to produce the $2^n$ tone display voltages.

By disposing the buffer means in the preceding stage of the voltage dividing means, distortion is reduced in waveform of the voltage supplied to the voltage dividing means, and consequently, distortion is reduced in waveform of the tone display voltage outputs from the voltage dividing means. On account of this, display quality deterioration caused by output waveform distortion can be restrained even when the tone display voltages are supplied to the liquid crystal panel through the selecting means with no further processing. In other words, good display quality is ensured without providing, to each output terminal connected to the liquid crystal panel, an output circuit that occupies a large area and consumes large power as in a conventional example. Meanwhile, the buffer means provided to the standard voltage producing means is far smaller in layout area and power consumption than conventional configurations in which each output terminal has its own buffer means.

Therefore, with the structure, a small, energy efficient liquid crystal driver can be fabricated, and a small- to medium-sized liquid crystal display for use in small, energy efficient portable devices can be fabricated by applying the liquid crystal driver in the liquid crystal display.

In order to achieve the objective, a liquid crystal display in accordance with the present invention is characterized in that it includes the liquid crystal driver and a liquid crystal panel driven by the liquid crystal driver.

The forgoing liquid crystal driver is smaller and capable of running on lower power consumption, and still does not loose its good display quality. By arranging a liquid crystal display from the liquid crystal driver and the liquid crystal panel, for example, a small- to medium-sized liquid crystal display for use in small, energy efficient portable devices can be fabricated.

For a fuller understanding of the nature and advantages of the invention, reference should be made to the ensuing detailed description taken in conjunction with the accompanying drawings.

DESCRIPTION OF THE EMBODIMENTS

[Embodiment 1]

The following will describe an embodiment in accordance with the present invention in reference to figures.

The structure of the liquid crystal display including the liquid crystal driver detailed below, the structure of the liquid crystal panel in a liquid crystal display, and the liquid crystal drive waveforms are identical to those mentioned above in reference to FIGS. 9–12, and description thereof is omitted here. The following description will focus on liquid crystal drivers (source drivers), a feature of the present invention.

Figure 2:
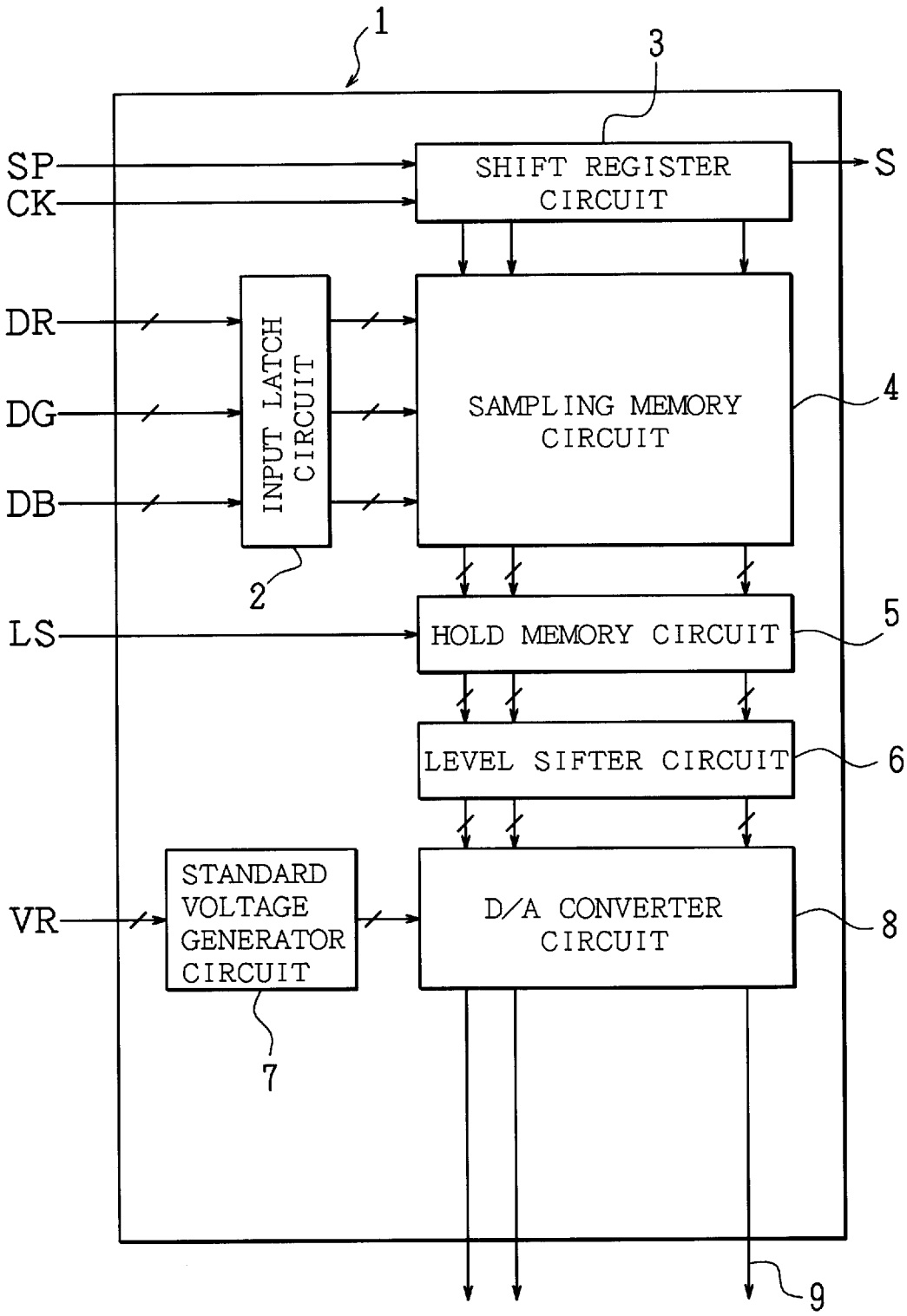
FIG. 2 is a block diagram showing a schematic structure of the source driver.

FIG. 2 depicts a schematic structure of a source driver 1 that is a liquid crystal driver in accordance with the present invention. The source driver 1 is formed by an input latch circuit 2, a shift register circuit 3, a sampling memory circuit 4, a hold memory circuit 5, a level shifter circuit 6, a standard voltage generator circuit 7, and a D/A converter circuit 8.

Digital display data sets DR, DG, DE (for example, 6 bits) transmitted from a controller (not shown) are temporarily latched by the input latch circuit 2. The digital display data sets DR, DG, DE correspond to red, green, and blue respectively.

Meanwhile, a start pulse signal SP is shifted through the shift register circuit 3 in synchronism with a clock signal CK and appears at the last stage of the shift register circuit 3, from which the start pulse signal SP (cascade output signal S) is supplied to a next source driver.

The digital display data sets DR, DG, DE latched by the input latch circuit 2 are temporarily stored serially in the sampling memory circuit 4 in synchronism with output signals from a number of stages of the shift register circuit 3 and transmitted to a hold memory circuit 5 in the next stage.

As display data for one horizontal synchronization period is stored in the sampling memory circuit 4, the hold memory circuit 5 acquires an output signal from the sampling memory circuit 4 based on the horizontal synchronizing signal (latch signal Ls) to supply to a level shifter circuit 6 in the next stage and to retain the display data until an input of a succeeding horizontal synchronizing signal.

The level shifter circuit 6 boosts or otherwise changes a signal level so that the signal is suitable to a D/A converter circuit 8, in the next stage, which processes the level of a voltage applied to the liquid crystal panel. The standard voltage generator circuit 7 produces analog voltages from a reference voltage VR fed from the aforementioned liquid crystal power supply (not shown) for outputs to the D/A converter circuit 8 to effect a tone display.

The standard voltage generator circuit 7 has a different structure from conventional counterparts, which is a feature of the present invention. Detail will be given later.

The D/A converter circuit 8 chooses, from the analog voltages supplied from the standard voltage generator circuit 7, an analog voltage suitable to the display data of which the level is shifted by the level shifter circuit 6. The analog voltage representative of a tone display is transmitted from the D/A converter circuit 8 directly through the associated liquid crystal drive voltage output terminal (hereinafter, output terminal) 9 to one of the source signal lines of the liquid crystal panel.

Therefore, the source driver 1 is not provided with a circuit that is an equivalent to an output circuit conventionally provided corresponding to output terminals 9, but includes such a structure to directly supply the output from the D/A converter circuit 8 to the liquid crystal panel.

The standard voltage generator circuit 7 and the D/A converter circuit 8 forms a part of a D/A converter. In the liquid crystal display, it could also be said that the inclusion of the D/A converter as a part of the liquid crystal drive circuit (source driver) enables the D/A converter to convert the digital data (display data sets DR, DG, DB) to be displayed on the liquid crystal panel from digital to analog before applying the data set to the liquid crystal display elements.

Figure 3:
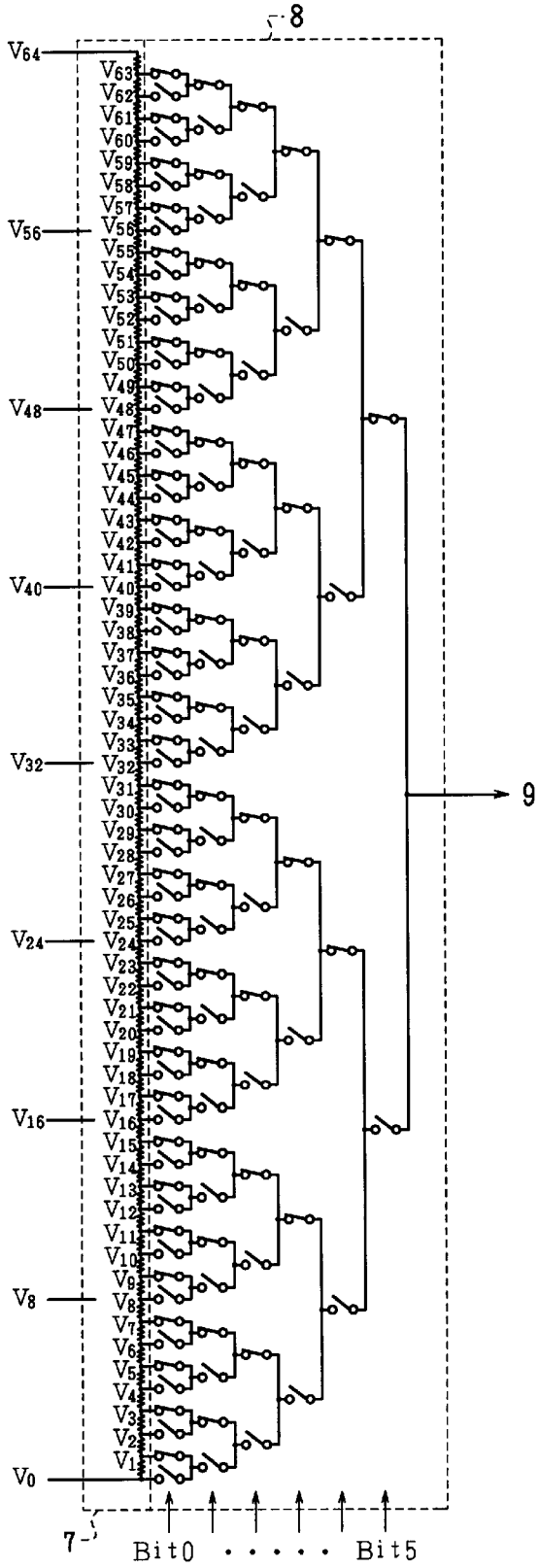
FIG. 3 is a diagram depicting a schematic structure of a D/A converter formed by the standard voltage generator circuit and a D/A converter circuit, in particular the structure of the D/A converter circuit.
Figure 16:
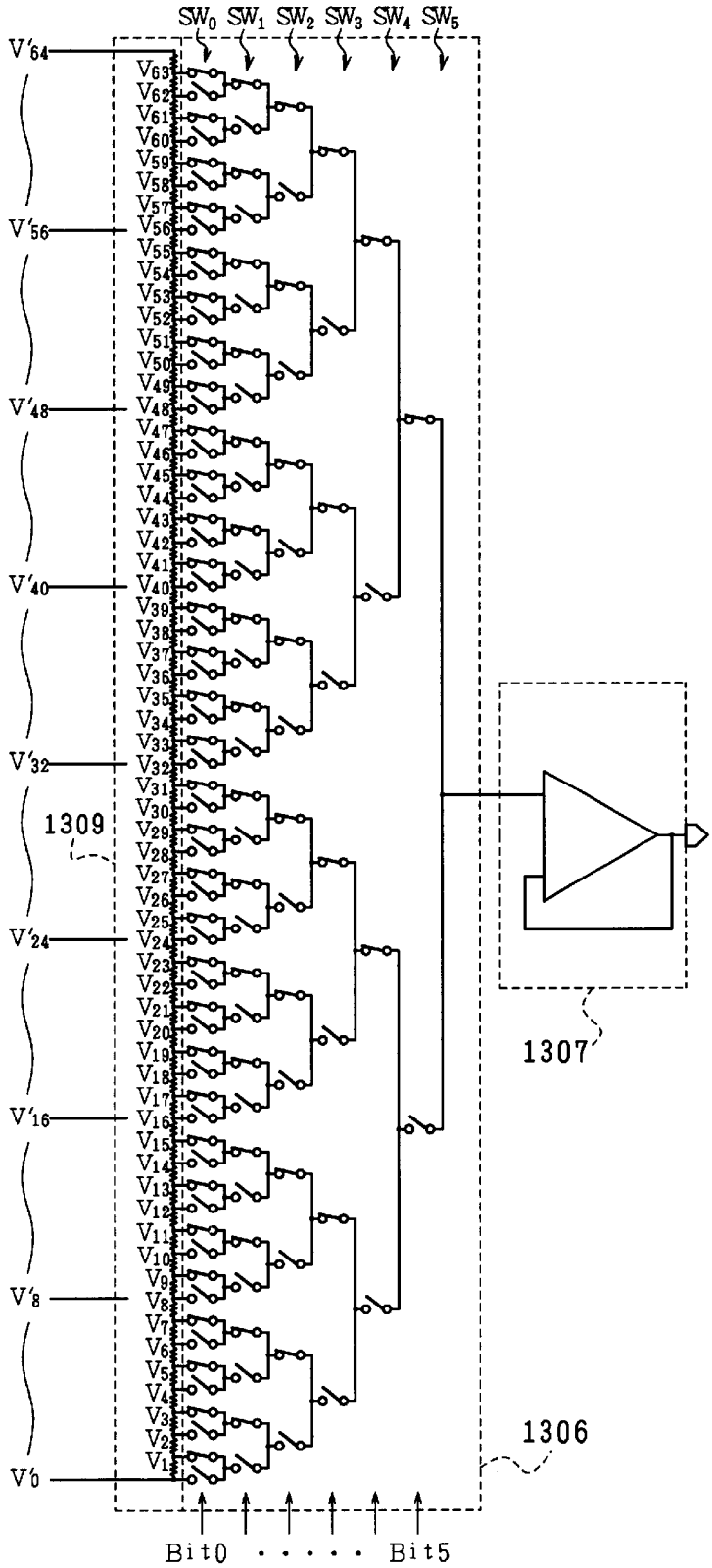
FIG. 16 is a diagram depicting a schematic structure of the standard voltage generator circuit, D/A converter circuit, and output circuit provided in the source driver.

FIG. 3 shows a schematic structure of the D/A converter. As is observable in the figure, the D/A converter circuit 8 has the same structure as a conventional equivalent of FIG. 16. The voltage follower circuit as an output circuit provided to each output terminal 9 is omitted from the figure. It would be understood that the tone display analog voltage selected by the D/A converter circuit (analog switch circuit) 8 in accordance with the digital display data is directly applied to a source signal line of the liquid crystal panel as the liquid crystal drive voltage as mentioned earlier.

Next, the standard voltage generator circuit 7, a feature of the present invention, will be described in detail. In the following description, it is assumed, as an example, that each digital display data set DR, DG, DB is 6 bits.

Figure 1:
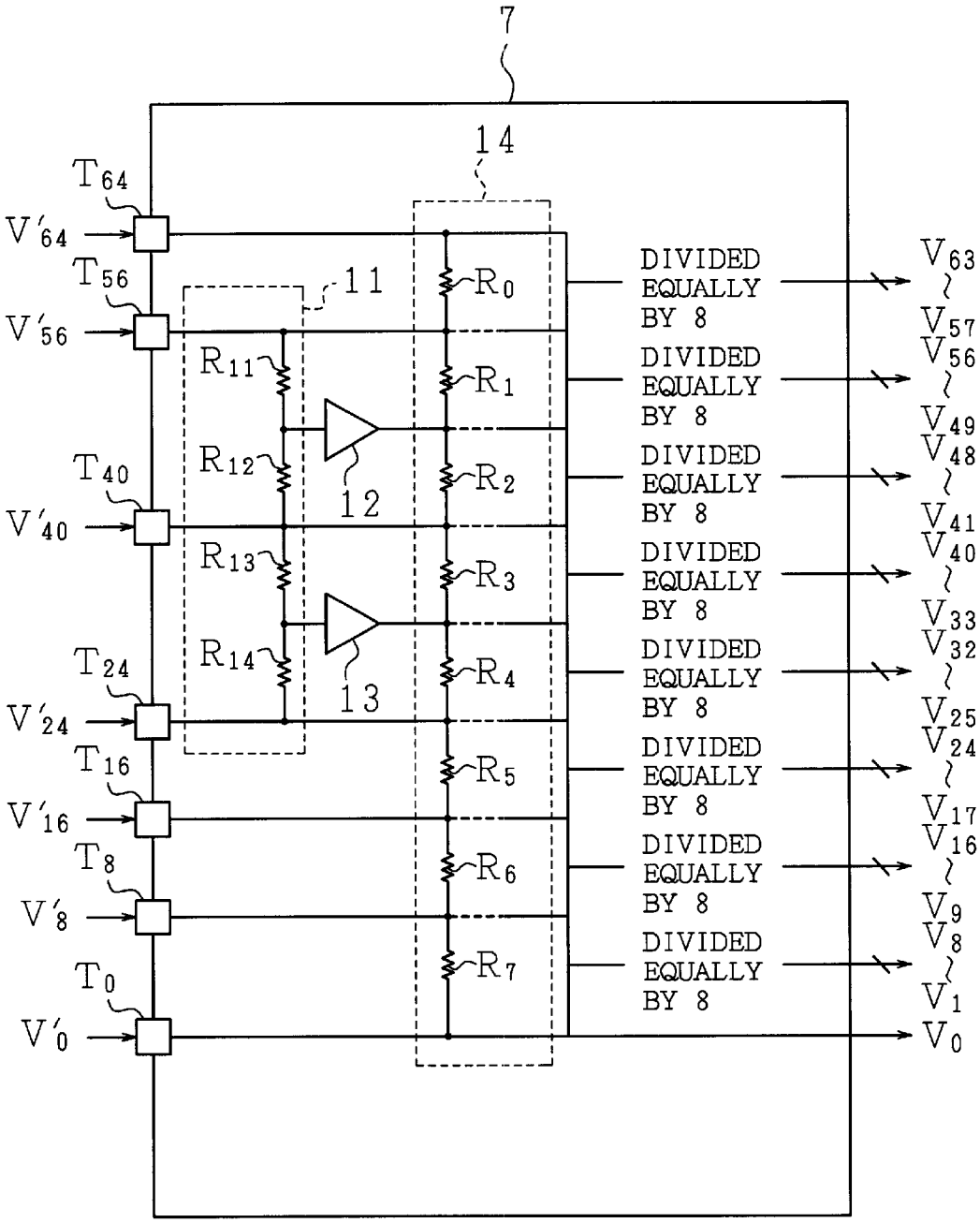
FIG. 1 is a diagram depicting a schematic structure of a standard voltage generator circuit in a source driver that is a liquid crystal driver of an embodiment in accordance with the present invention.

FIG. 1 shows details of the structure of the standard voltage generator circuit 7. The standard voltage generator circuit 7 produces $2^n$ (here, 64) tone display voltages from two or more incoming reference voltages (first reference voltages) in accordance with n-bit (here, 6-bit) display data. It could there be said that the D/A converter circuit 8 forms selecting means for selecting a voltage from the $2^n$ tone display voltages produced by the standard voltage generator circuit 7 in accordance with incoming display data and directly supplying the selected voltage to the liquid crystal panel through the output terminals.

Figure 14:
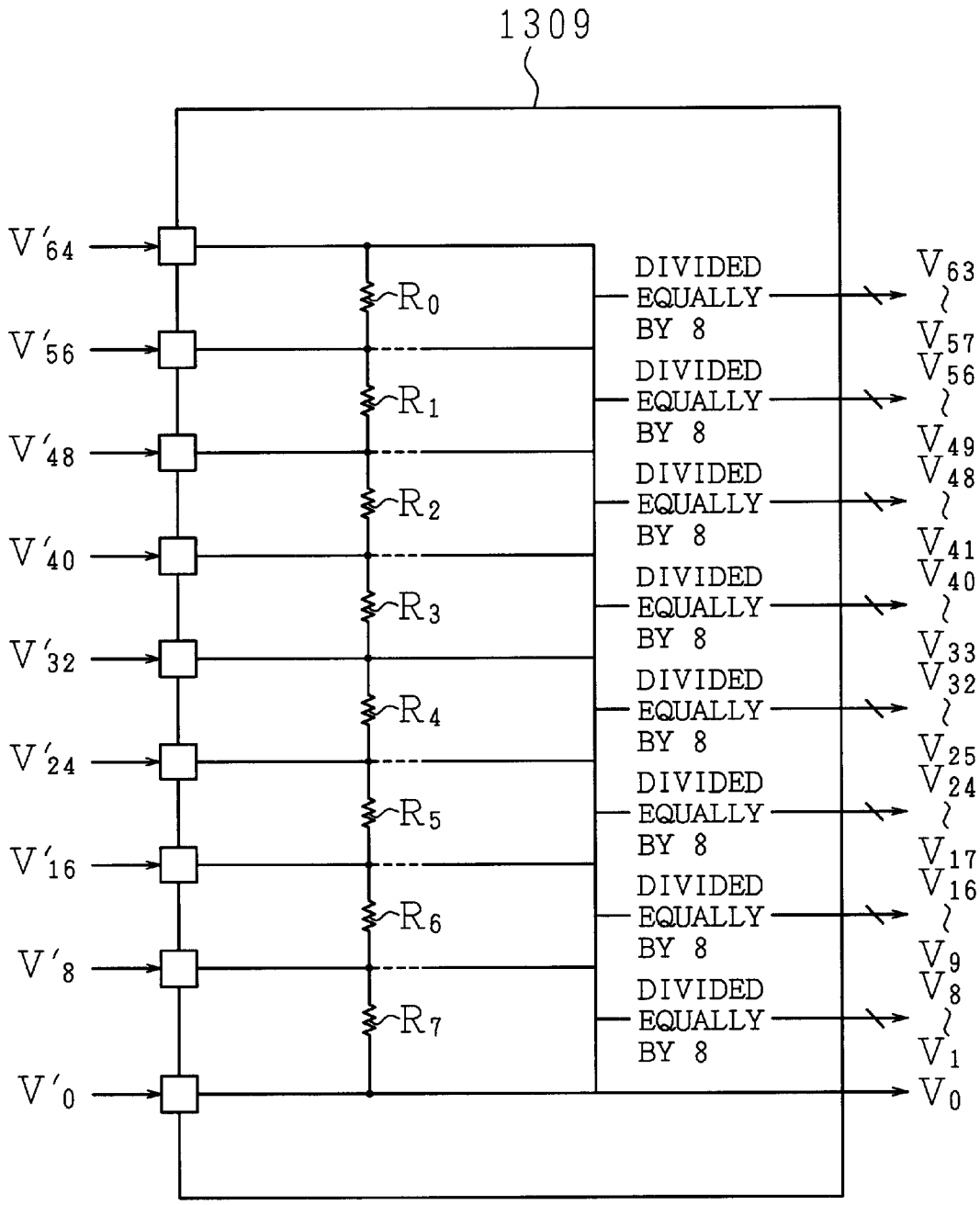
FIG. 14 is a block diagram depicting a schematic structure of a standard voltage generator circuit provided in he source driver.

Assume here that there exist seven reference voltages $V'_0$, $V'_8$, $V'_{16}$, $V'_{24}$, $V'_{40}$, $V'_{56}$, $V'_{64}$. The standard voltage generator circuit 7, as shown in the figure, has halftone voltage input terminals $T_0$, $T_8$, $T_{16}$, $T_{24}$, $T_{40}$, $T_{56}$, $T_{64}$ for the seven reference voltages respectively. The standard voltage generator circuit 7 in accordance with the present embodiment differs from the conventional standard voltage generator circuit of FIG. 14 in that the former lacks halftone voltage input terminals for the reference voltages $V'_{32}$, $V'_{48}$.

The standard voltage generator circuit 7 further includes a generation circuit (generation means) 11, buffer circuits (buffer means) 12, 13, and a resistance divider circuit (voltage dividing means, first resistance divider circuit) 14.

The generation circuit 11 produces anew a number of voltages from reference voltages that are adjacent when arranged in either ascending or descending order, the resultant voltage falling between those adjacent ones. The generation circuit 11 is formed by a resistance divider circuit (second resistance divider circuit) composed of the resistors $R_{11}$, $R_{12}$, $R_{13}$, $R_{14}$ connected in series.

In the present embodiment, the resistors $R_{11}$, $R_{12}$ are connected in series correspondingly between the reference voltages $V'_{40}$, $V'_{56}$, whereas the resistors $R_{13}$, $R_{14}$ are connected in series correspondingly between the reference voltages $V'_{24}$, $V'_{40}$. Thus, a voltage with an intermediate level between the reference voltages $V'_{40}$, $V'_{56}$ can be derived from the contact of the resistors $R_{11}$, $R_{12}$ in accordance with the ratio of resistances of the resistors $R_{11}$, $R_{12}$. Likewise, a voltage with an intermediate level between the reference voltages $V'_{24}$, $V'_{40}$ can be derived from the contact of the resistors $R_{13}$, $R_{14}$ in accordance with the ratio of resistances of the resistors $R_{13}$, $R_{14}$.

Referring to the voltages newly produced in the generation circuit 11 as the second reference voltages, the resistors $R_{11}$, $R_{12}$, $R_{13}$, $R_{14}$ can be said to be provided correspondingly between an adjacent first reference voltage and a second reference voltage in the structure of the generation circuit 11. In the present embodiment, it would be correct to understand that the reference voltages $V'_{32}$, $V'_{48}$ are not externally supplied, but internally generated as the second reference voltages by the generation circuit 11.

In the resistance divider circuit 14, the ratio of the resistances of the resistors $R_{11}$, $R_{12}$, $R_{13}$, $R_{14}$ is likewise specified to be equal to the ratio of the resistances (detailed later) of the resistors $R_1$, $R_2$, $R_3$, $R_4$ provided correspondingly between a first reference voltage and an adjacent second reference voltage.

Each buffer circuit 12, 13 is a circuit that convert the voltages newly produced by the generation circuit 11 in terms of impedance for output and is formed by, for example, a voltage follower circuit. The buffer circuit 12, 13 has a function to reduce distortion in the output waveform by means of the impedance conversion.

This indicates that the buffer circuit 12, 13 should be provided for such a voltage, among the 64 tone display voltages $V_0$–$V_{63}$, that the rising or falling output waveform is distorted if the voltage is fed from the resistance divider circuit 14 to directly to the source signal lines of the liquid crystal panel through the D/A converter circuit 8 (see FIGS. 2, 3). This is reflected in the present embodiment in, for example, the provision of the buffer circuit 12 between the interconnection of the resistors $R_{11}$, $R_{12}$ in the generation circuit 11 and the interconnection of the resistors $R_1$, $R_2$ in the resistance divider circuit 14. The buffer circuit 13 is provided, for the same reasons, between the interconnection of the resistors $R_{13}$, $R_{14}$ in the generation circuit 11 and the interconnection of the resistors $R_3$, $R_4$ in the resistance divider circuit 14.

The resistance divider circuit 14 is a circuit that produces voltages of intermediate levels between those of adjacent first reference voltages and of adjacent first and second reference voltages by means of voltage dividing so as to produce the $2^n$ tone display voltages, and is specifically configured in the following manner.

Figure 15:
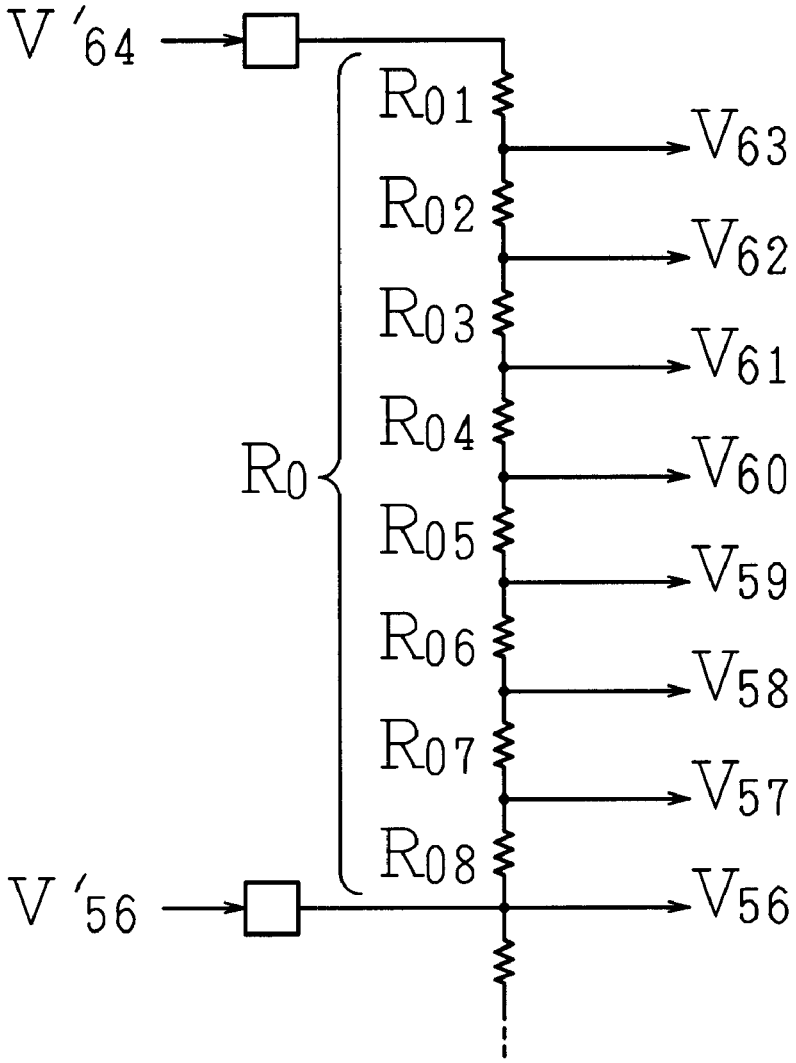
FIG. 15 is a circuit diagram depicting in detail a structure of resistors constituting a resistance divider circuit provided in the standard voltage generator circuit.

The resistance divider circuit 14 is formed by the resistors $R_0$–$R_7$ connected in series. Each resistor $R_0$–$R_7$ is formed by eight resistor elements connected in series. Taking the resistor $R_0$ as an example, like the conventional example shown in FIG. 15, eight resistor elements $R_{01}$, $R_{02}$, . . . $R_{08}$ are connected in series to form the resistor $R_0$. The other resistors $R_0$–$R_7$ are configured in the same manner as the resistor $R_0$. The resistance divider circuit 14 is therefore formed by 64 resistor elements connected in series in all.

The resistor $R_0$ is connected at an end thereof to a halftone voltage input terminal $T_{64}$ for the reference voltage $V'_{64}$ and at the other end, i.e., the contact of the resistors $R_0$ and $R_1$, to a halftone voltage input terminal $T_{56}$ for the reference voltage $V'_{56}$. Likewise, the contacts of the resistors $R_2$, $R_3$; $R_4$, $R_5$; $R_5$, $R_6$; and $R_6$, $R_7$ are connected to respective halftone voltage input terminals $T_{40}$, $T_{24}$, $T_{16}$, $T_8$ for the reference voltages $V'_{40}$, $V'_{24}$, $V'_{16}$, $V'_8$. A halftone voltage input terminal $T_{20}$ for the reference voltage $V'_0$ is connected to one of the ends of the resistor $R_7$ at which the resistor $R_6$ is not connected.

Meanwhile, the contact between the resistors $R_1$, $R_2$ is connected to the output from the buffer circuit 12, whereas the contact between the resistors $R_3$, $R_4$ is connected to the output from the buffer circuit 13.

The configuration enables the voltages $V_1$–$V_{63}$ to be picked up at the contacts between the 64 resistor elements in the resistance divider circuit 14. The voltages $V_1$–$V_{63}$, plus the voltage $V_0$ coming straight from the reference voltage $V'_0$, provide 64 different analog voltages $V_0$–$V_{63}$ as tone display voltages. Hence, the voltages $V_0$–$V_{63}$ are determined by the ratio of resistances of the 64 resistor elements.

Figure 17:
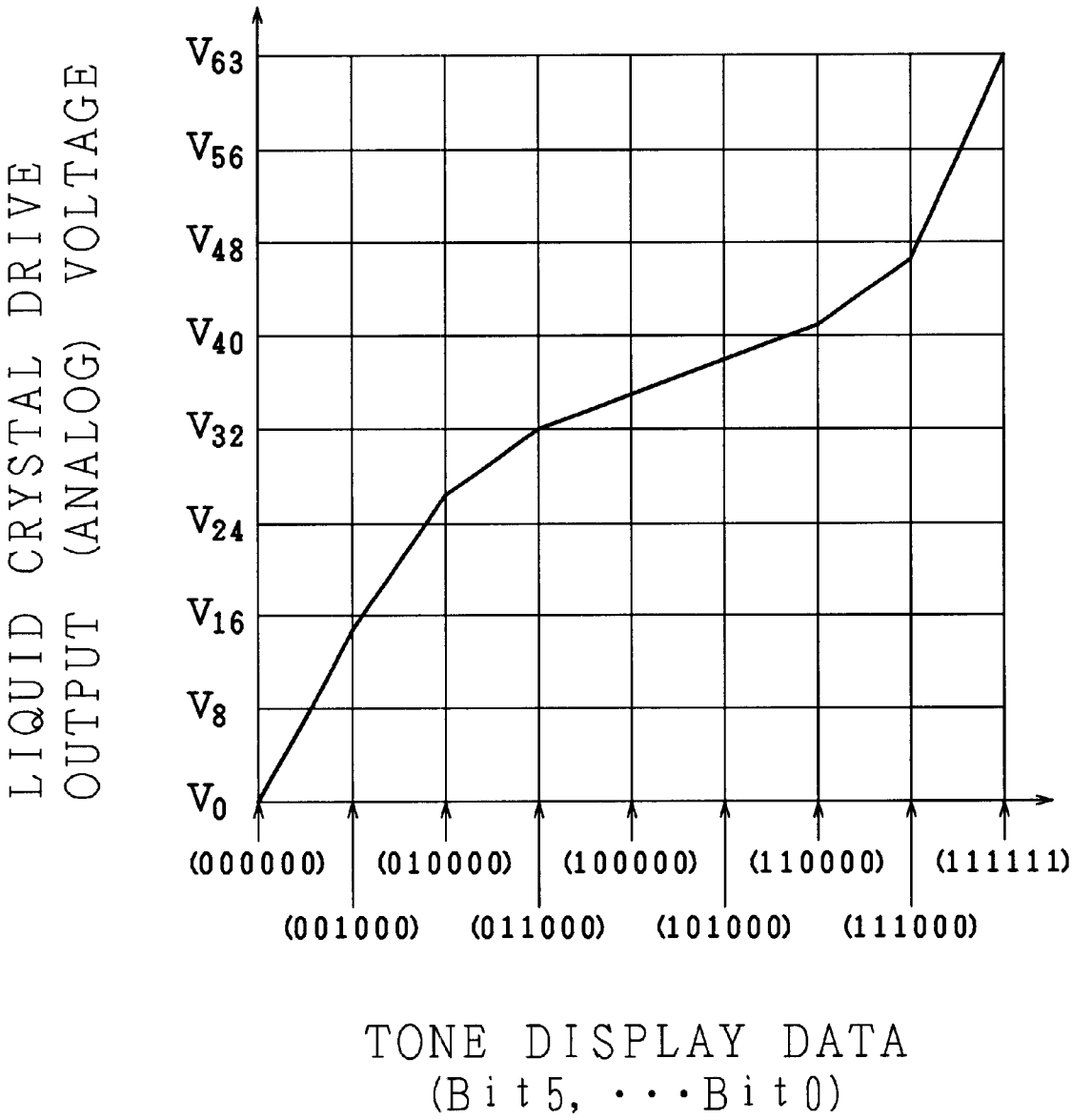
FIG. 17 is a graph showing the relationship between tone display data and a liquid crystal drive output voltage when gamma correction is applied.

The ratio of the resistances of the resistors $R_0$–$R_7$ is specified so as to effect a gamma correction for a naturally looking tone display, in consideration of differences between human vision and the actual light transmission characteristics of the liquid crystal material in the liquid crystal display. That is, the ratio of the resistances of the resistor $R_0$–$R_7$ is specified so that the relationship between the tone display voltages and the tone display data can be represented by the zigzag line shown in FIG. 17. For this reason, the internal resistance of the resistance divider circuit 14 is not equally divided.

Note that in the present embodiment, each of the resistors $R_0$, . . . $R_7$ is divided into identical eight parts so that the eight resistor elements making up the resistor are all identical in resistance. The resistor elements may, however, have different resistances from each other in accordance with gamma characteristics. When this is the case, more detailed specifications become possible.

In the present embodiment, as mentioned above, locating the buffer circuit 12, 13 immediately before the resistance divider circuit 14 where there occurs a large waveform distortion successfully reduces the distortion in the waveforms of the reference voltages $V'_0$–$V'_{63}$ supplied to the resistance divider circuit 14 and in turn the distortion in the waveforms of the output tone display voltages $V_0$–$V_{63}$ from the resistance divider circuit 14. The structure is capable of preventing the load capacity from taking an extended period of time in charging and discharging due to distortion in output waveforms and effecting a display of satisfactory quality for practical use, even if the tone display voltages $V_0$–$V_{63}$ produced by means of the resistors $R_0$–$R_7$ of which the resistance ratio is specified to impart gamma characteristics are directly fed to the source signal lines of the liquid crystal panel through the D/A converter circuit 8 formed by analog switches.

This ensures good display quality without providing to each output terminal an analog output circuit that occupies a large area and consumes large power as in a conventional example. The resulting source driver 1 is therefore small in size and runs on low power consumption with no compromise on display quality. The source driver 1 of the present embodiment is therefore suitable for use with small- to medium-sized liquid crystal displays in portable and other similar devices.

The miniaturization and low power consumption feature of the source driver 1 facilitate the entire or partial integration of the source driver 1, the controller, liquid crystal power supply, and gate drivers on a single chip, which in turn reduces the size and power consumption of the liquid crystal driver as a whole. The miniaturization of the liquid crystal driver as a whole can also lead to cost reductions.

The layout area and power consumption of the analog buffer circuits 12, 13 are far smaller in the present embodiment where the buffer circuits 12, 13 are provided in the standard voltage generator circuit 7 in each source driver 1 than a conventional example where an output circuit is provided to each output terminal 9. Further, the reduced number of output circuits means a reduced output resistance compared to prior art; the transistors of the analog switches making up the D/A converter circuit 8 are increased in size by expanding the gate width thereof, for example, the reduction in the layout area owing to the omission of the analog output circuit in each output terminal 9 is by far larger.

An experimental liquid crystal driver to drive a liquid crystal panel with 560×240 pixels for use in small- to medium-sized liquid crystal displays was fabricated including an only one buffer circuit provided correspondingly between the reference voltages $V'_{24}$, $V'_{40}$, with only the halftone voltage input terminal $T_{32}$ for the reference voltage $V'_{32}$ omitted; it was confirmed that the experimental driver operated satisfactorily in display generation and would cause no problems in practical use.

Alternatively, the source driver 1 may include a buffer circuit provided correspondingly between other adjacent reference voltages (for example, the reference voltages $V'_{16}$, $V'_{24}$).

In the present embodiment, the input terminal is omitted to which the first reference voltages (for example, reference voltages $V'_{32}$, $V'_{48}$) that correspond to the second reference voltage produced by the generation circuit 11 is connected. This is because the provision of the generation circuit 11 makes it possible to obtain the second reference voltage replacing an external reference voltage and eliminates the need to provide a halftone voltage input terminal for the external reference voltage.

This omission of a halftone voltage input terminal for an external reference voltage makes it possible to reduce the number of wires required in the supply of reference voltages from the liquid crystal power supply to the source driver 1, further reducing the size of the liquid crystal driver and hence the size of the liquid crystal display. Besides reducing the output circuits of the liquid crystal power supply, the less wires are also advantageous to a less power consumption and impermeable to noise over the wires. The layout design of the terminals of the source driver 1 is made easier, because the source driver 1 does not have as many terminals, including the output terminal 9, as before.

In the present embodiment, the halftone voltage input terminals is reduced from nine to seven; the omitted input terminal is determined in accordance with the provision of a buffer circuit for such a voltage that the load capacity of the liquid crystal panel takes longer to charge and discharge as mentioned previously. There is no global criterion as to which terminal should be omitted.

As mentioned above, the ratio of the resistances of the resistor $R_{11}$, $R_{12}$, $R_{13}$, $R_{14}$ in the generation circuit 11 is specified to be equal to that of the resistance values of the resistor $R_1$, $R_2$, $R_3$, $R_4$ in the resistance divider circuit 14. In other words, the resistors in the resistance divider circuit 14 are configured in such a resistance ratio that can effect a gamma correction. This allows the resistor in the generation circuit 11 to be also configured in such a resistance ratio that can effect a gamma correction. The gamma correction, thus effected both in the generation circuit 11 and in the resistance divider circuit 14, ensures creation of a naturally looking tone display in accordance with human vision based on the 64 tone display voltages produced by the resistance divider circuit 14.

Further, the provision of the buffer circuits 12, 13 makes it possible to amplify the second reference voltages produced by the generation circuit 11 before supplied to the resistance divider circuit 14. In other words, the resistors $R_{11}$, $R_{12}$, $R_{13}$, $R_{14}$ in the generation circuit 11 can be specified to a very high resistance values compared to the resistors $R_1$, $R_2$, $R_3$, $R_4$; there are less restraints in the specifying the resistance values for the resistors $R_{11}$, $R_{12}$, $R_{13}$, $R_{14}$.

Typically, the two reference voltages $V'_0$ and $V'_{64}$ that appear at the respective ends are always supplied to the standard voltage generator circuit 7, and the halftone voltage input terminals $T_8$–$T_{56}$ are connected to the remaining reference voltages $V'_8$–$V'_{56}$ and used for fine adjustment. In some cases, however, no voltage is applied to these terminals.

Therefore, the generation circuit 11 is preferably provided, as in the present embodiment, so that the circuit is capable of producing as the second reference voltage a voltage having a level either equal or close to a mid-level of the input range of a plurality of first reference voltages (a voltage other than the reference voltage $V'_0$ which is the minimum in the input range and the reference voltage $V'_{64}$ which is the maximum in the input range). The buffer circuits are preferably provided corresponding to the second reference voltages produced by the generation circuit 11. This ensures that even if no voltages are supplied which are far from the reference voltages $V'_0$ and $V'_{64}$ the 64 tone display voltages $V_0$–$V_{63}$ are obtainable from the remaining, incoming first reference voltages and the second reference voltages produced by the generation circuit 11. The voltage with a level either equal or close to a mid-level of the input range of a plurality of first reference voltages may be any one of the remaining seven reference voltages $V'_8$, $V'_{16}$, $V'_{24}$, $V'_{32}$, $V'_{40}$, $V'_{48}$, $V'_{56}$.

The generation circuit 11, together with the buffer circuits, are preferably provided corresponding to a voltage of which the output waveform is too distorted to disregard due to high resistance when the ratio of the resistances of the resistors $R_0$–$R_7$ in the resistance divider circuits 14 is changed to implement a gamma correction.

[Embodiment 2]

Referring to drawings, the following will describe another embodiment in accordance with the present invention. Here, for convenience, members of the present embodiment that have the same arrangement and function as members of embodiment 1, and that are mentioned in that embodiment are indicated by the same reference numerals and description thereof is omitted.

Figure 4:
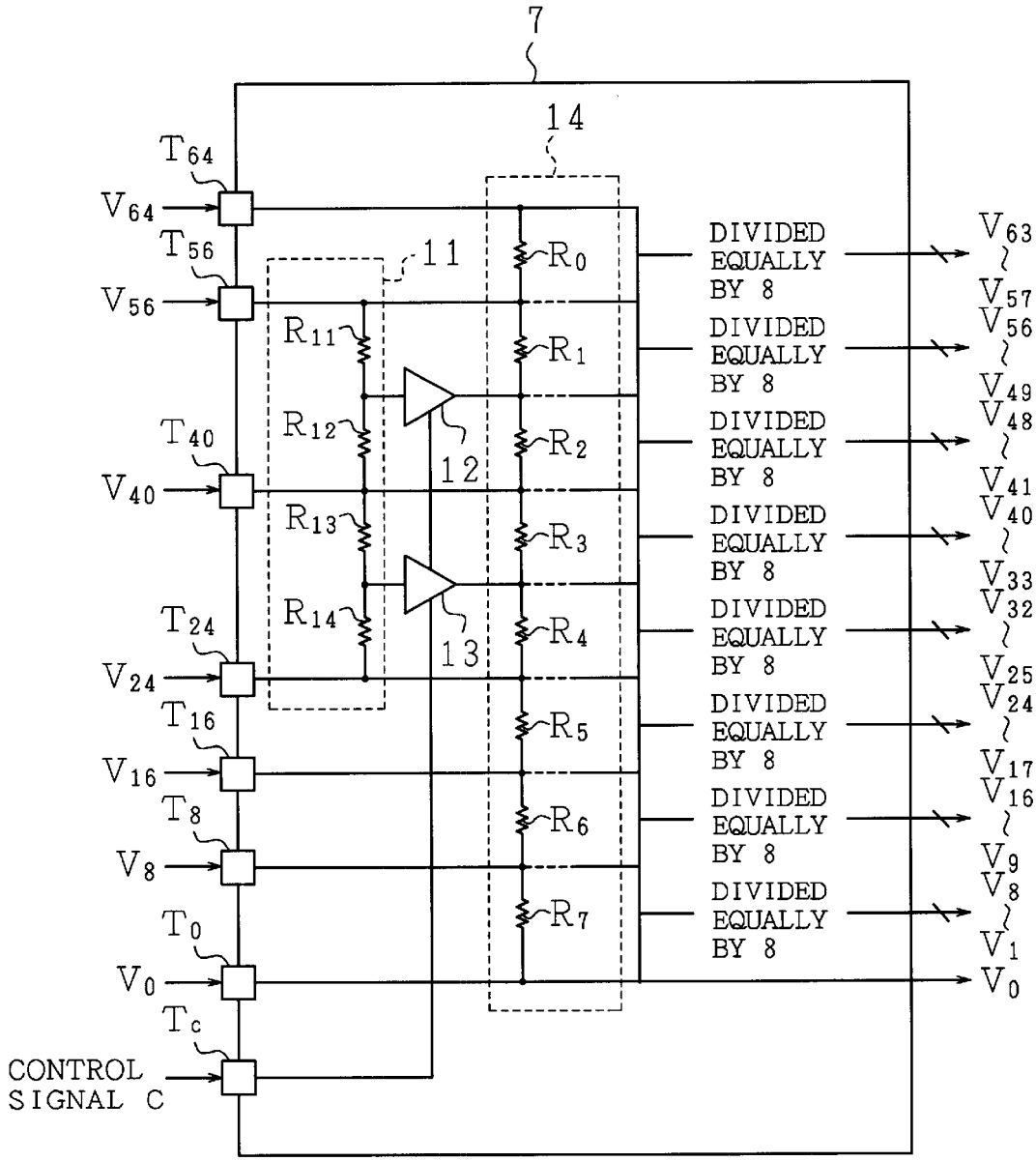
FIG. 4 is a diagram depicting a schematic structure of a standard voltage generator circuit in a source driver that is a liquid crystal drive circuit of another embodiment in accordance with the present invention.

The present embodiment differs from embodiment 1 only in that the standard voltage generator circuit 7 of the present embodiment has an input terminal $T_C$ (see FIG. 4) to which an external control signal C is coupled, for example, from a controller and that the buffer circuits 12, 13 each include a later-detailed control section 22 (see FIG. 5) that controls an operating current in the circuit based on the control signal C. The description below will therefore focus on this feature. Since the buffer circuits 12, 13 are identical, the buffer circuit 12 is taken as an example in the following.

Figure 5:
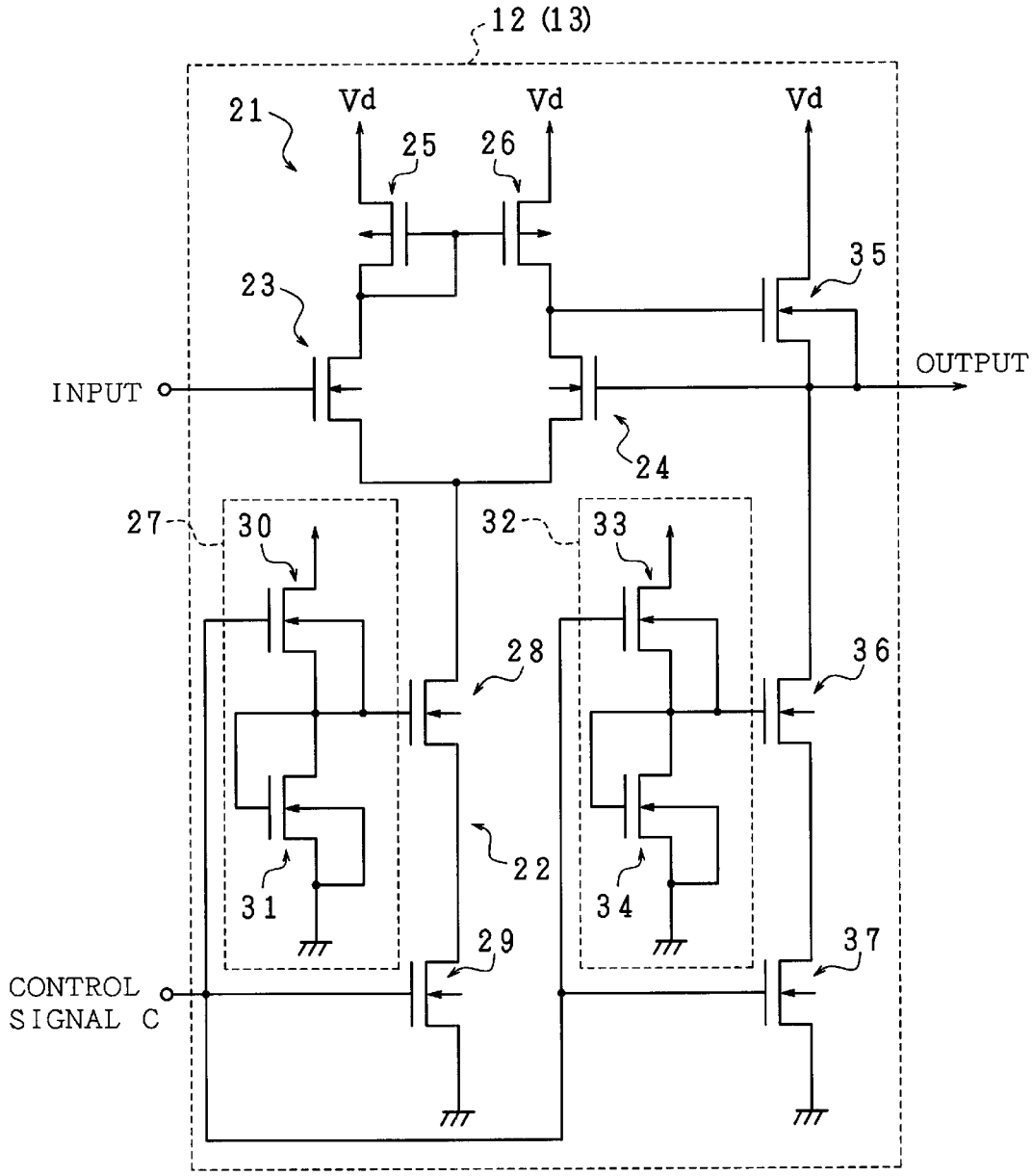
FIG. 5 is a circuit diagram depicting a schematic structure of a buffer circuit provided in the standard voltage generator circuit.

FIG. 5 shows a schematic diagram showing a structure of the buffer circuit 12 that is formed by a voltage follower circuit 21 and a control section 22.

The voltage follower circuit 21 includes N-channel MOS (hereinafter, NMOS) transistors 23, 24 and P-channel MOS (hereinafter, PMOS) transistors 25, 26. The NMOS transistors 23, 24 form a differential pair. Meanwhile, the PMOS transistors 25, 26 form a current mirror circuit (active load circuit).

The gate of the NMOS transistor 23 is connected to an input terminal as an identical-phase input terminal. The NMOS transistors 23, 24 are interconnected through their sources which are in turn connected to the drain of the NMOS transistor 28 of the control section 22 (detailed later). The gate (inverse-phase input terminal) of the NMOS transistor 24 is connected to the source of the NMOS transistor 35 and the drain of the NMOS transistor 36 to form an output terminal. The gate of the NMOS transistor 35 is connected to the drain of the NMOS transistor 24. The source of the NMOS transistor 35 is connected to a power supply Vd.

The drain of the NMOS transistor 23 is connected to the drain of the PMOS transistor 25, and the source of the PMOS transistor 25 is connected to the power supply Vd. Meanwhile, the drain of the NMOS transistor 24 is connected to the drain of the PMOS transistor 26, and the source of the PMOS transistor 26 is connected to the power supply Vd.

Meanwhile, the control section 22 includes a bias voltage specification section 27 which determines an operating point for the differential amplifier section, a NMOS transistor 28 for transmitting an operating current for the differential section, a NMOS transistor 29 which serves as a switching element to turn on/off an operating current for the differential amplifier section, a bias voltage specification section 32 which determines an operating point for the output section, a NMOS transistor 36 for transmitting an operating current for the output section, and a NMOS transistor 37 which serves as a switching element to turn on/off an operating current for the output section.

The bias voltage specification section 27 is formed by NMOS transistors 30, 31. The gate of the NMOS transistor 30 receives the control signal C. The source of the NMOS transistor 30 is connected to the gate and drain of the NMOS transistor 31 and to the gate of the NMOS transistor 28. The gate of the NMOS transistor 28 therefore receives a bias voltage. The drain of the NMOS transistor 30 is connected to a power supply (not shown). The source of the NMOS transistor 31 is either grounded or connected to a standard potential.

Meanwhile, the bias voltage specification section 32 in the output section is formed by NMOS transistors 33, 34 and configured identically to the bias specification section 27 in the differential amplifier section. The gate of the NMOS transistor 33 receives the control signal C as does the gate of the NMOS transistor 37. The source of the NMOS transistor 33 is connected to the gate of the NMOS transistor 36. The source of the NMOS transistor 36 is connected to the drain of the NMOS transistor 37. The source of the NMOS transistor 37 is grounded.

The source of the NMOS transistor 28 is connected to the drain of the NMOS transistor 29. The source of the NMOS transistor 29 is grounded. The gate of the NMOS transistor 29 receives the control signal C.

With the buffer circuit 12 thus configured, the control signal C is set to a HIGH when a circuit must operate and to a LOW when the circuit must not operate. A LOW control signal C turns off the NMOS transistor 31 which determines an operating point for the differential amplifier circuit and the NMOS transistor 34 which determines an operating point for the output section, causing the NMOS transistors 28, 36 for transmitting a bias current for the differential amplifier section and the output section respectively to not conduct. This causes the voltage follower circuit 21 to stop operating and consume no more current.

As detailed in the foregoing, the buffer circuit 12 of the present embodiment is adapted to set the output to a high output impedance through the control signal C and to cut off the operating current in the voltage follower circuit 21 which is a differential amplifier circuit when the circuit is not used. This ensures prevention of wasting electric power while the circuit is not being used and a large reduction of overall power consumption in the circuit.

Power consumption is reduced frequently if the control is carried out so as to stop the operation of the differential amplifier circuit when the liquid crystal display produces no display, as during blanking periods in a television system. Frequent reductions of power consumption are also possible in a portable device by stopping the operation of the differential amplifier circuit through the control signal C when the device has just been powered and the circuitry (including the circuitry other than the liquid crystal driver) has not reached a steady state yet.

[Embodiment 3]

Referring to drawings, the following will describe another embodiment in accordance with the present invention. Here, for convenience, members of the present embodiment that have the same arrangement and function as members of embodiments 1 and 2, and that are mentioned in those embodiments are indicated by the same reference numerals and description thereof is omitted.

Figure 6:
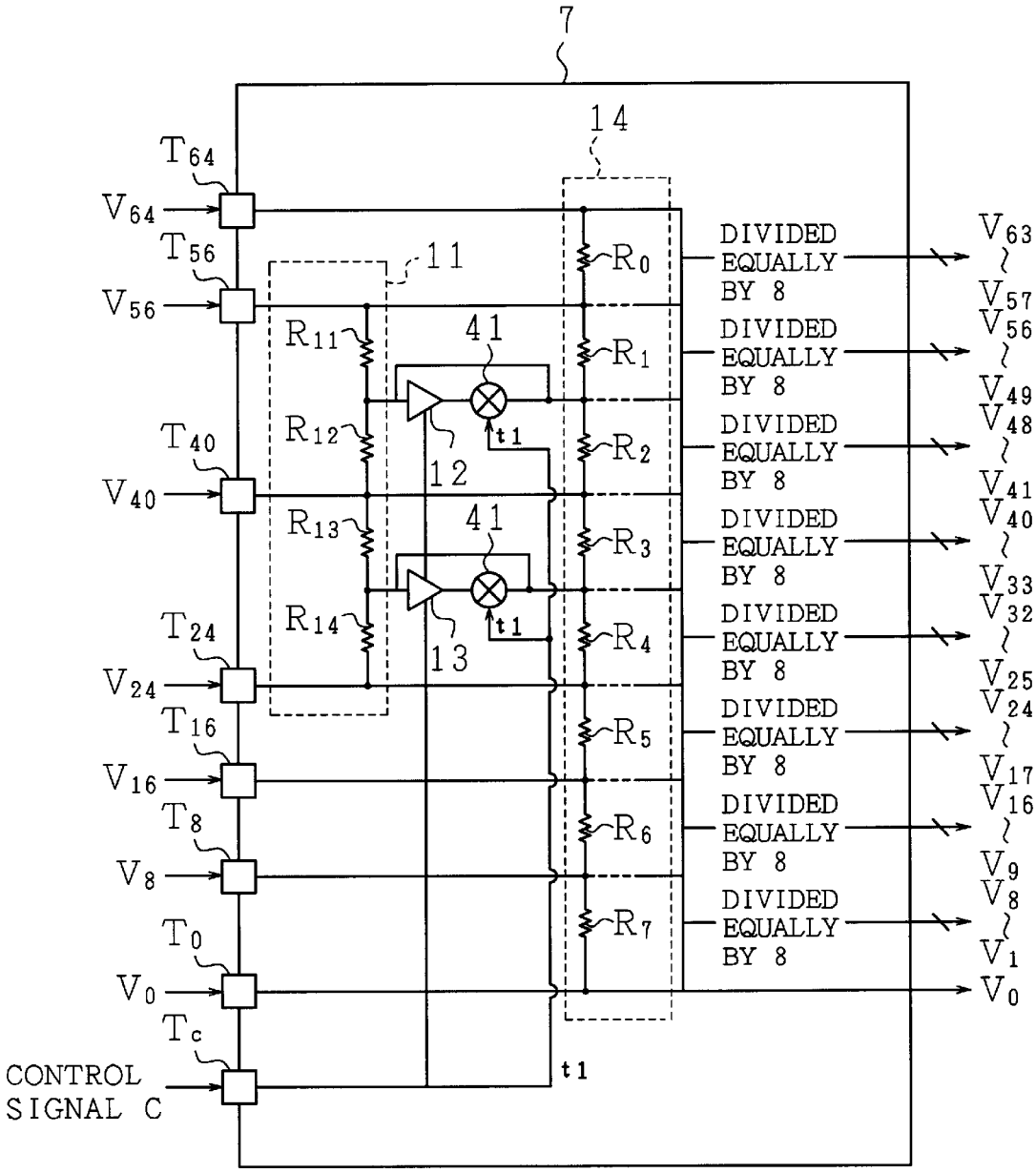
FIG. 6 is a diagram depicting a schematic structure of a standard voltage generator circuit in a source driver that is a liquid crystal drive circuit of a further embodiment in accordance with the present invention.

The present embodiment differs from embodiment 2 only in that the buffer circuits 12, 13 of the present embodiment each include a switch circuit 41 (see FIG. 6). The description below will therefore focus on this feature.

Referring to FIG. 6, the output of the buffer circuit (12, 13) is connected to an end of an input/output terminal of the switch circuit 41, whereas the other end of the input/output terminal of the switch circuit 41 is connected to the input terminal of the buffer circuit (12, 13).

The switch circuit 41 can be formed by an analog switch, such as an MOS transistor or a transmission gate. In the present embodiment, an analog switch is used as the switch circuit 41. The analog switch conducts (closes) when a control signal t1 is HIGH and does not conduct (opens) when the control signal t1 is LOW. Reasons why such switch circuits 41 are provided to the buffer circuits 12, 13 will be detailed later.

The buffer circuits 12, 13 have the same configuration as that described in embodiment 1 in reference to FIG. 5; detailed description thereof is omitted here.

The output of the buffer circuit 12 is connected to a contact between the resistors $R_1$, $R_2$. The output of the buffer circuit 13 is connected to a contact between the resistors $R_3$, $R_4$.

Here, the resistances of $R_1$, $R_2$ and those of $R_3$, $R_4$ are specified to satisfy $R_1:R_2=R_{11}:R_{12}$, and $R_3:R_4=R_{13}:R_{14}$. Reasons why the resistances are specified to such ratios will be detailed later.

The control terminal for controlling the opening/closing of the switch circuit 41 receives the control signal t1 which is the same signal as the control signal C. By the use of identical control signals C and t1, the input terminal $T_C$ of the source driver 1 can be shared between the control signal C and the control signal t1, reducing the total number of terminals.

The standard voltage generator circuit 7 of the present embodiment, including the buffer circuits 12, 13 configured as above, produces the tone display voltages $V_0$–$V_{63}$ that correspond to the digital display data sets DR, DG, DB latched in accordance with a latch signal Ls for output to the source signal lines of the liquid crystal panel as does the standard voltage generator circuit 7 of embodiment 1.

The gate signal lines of the liquid crystal panel receive incoming HIGH scan signals from gate drivers so as to turn on the TFTs in the liquid crystal panel. The tone display voltages $V_0$–$V_{63}$ are transmitted over the source signal lines and through the turned-on TFTs and applied to pixel capacitors connected to the drains of the TFTs to produce a display on the liquid crystal panel.

Figure 7:
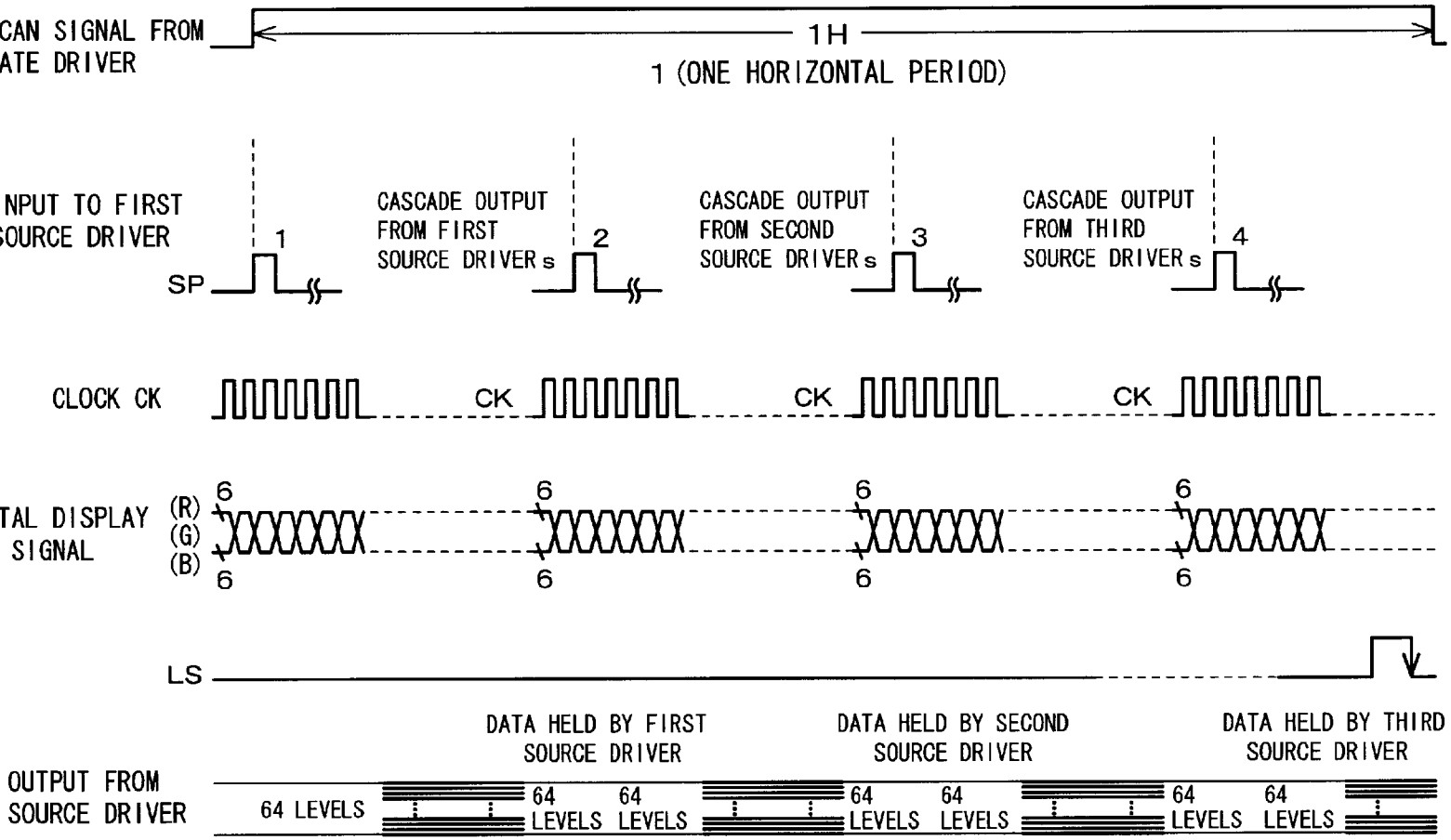
FIG. 7 is a timing chart showing input and output signals of the source driver.

Referring to FIG. 7, the latched digital display data is stored in the hold memory circuit 5 until another latch signal Ls is received. In FIG. 7, the source drivers 1, of which there are provided more than one in the liquid crystal display, are termed individually a first source driver, a second source driver, a third source driver, etc.

Therefore, upon reception of a latch signal Ls, the outputs of the source drivers are switched among tone display voltages $V_0$–$V_{63}$ in accordance with the digital display data sets DR, DG, DB, and remain so until a next latch signal Ls is received. By retaining the outputs at one of the tone display voltages $V_0$–$V_{63}$, the pixel capacitors in the pixels in the liquid crystal panel are charged/discharged.

Now, the following will describe why a switch circuit 41 is provided to each buffer circuit 12, 13.

A current surge occurs in some cases in the standard voltage generator circuit 7 immediately after the tone display voltages $V_0$–$V_{63}$ are applied to the pixel capacitor as in the foregoing. The surge subsides following a characteristic determined by a time constant of the capacitance of the pixel capacitors and the resistances, such as the TFT' ON resistance, source signal line resistance, and source driver's output impedance. The current drops to substantially 0 with ignorable leak current, when the voltage applied to the pixel capacitor comes to a steady state at the predetermined value.

To produce a good quality display on the liquid crystal display, the surge current possibly occurring in the standard voltage generator circuit 7 preferably come to a steady state at the desired tone display voltage $V_0$–$V_{63}$ as soon as possible. To this end, the source driver 1 needs to have a low output impedance when the source driver 1 produces a new tone display voltage for output in response to the reception of a latch signal Ls.

Besides, once the voltage applied to the pixel capacitor comes to a steady state at a predetermined value when a certain period of time TI (TI is set within a horizontal synchronization period) has elapsed, the display quality can be retained by applying a retainment voltage to retain the voltage at the predetermined steady-state value until the TFT turns off. While the retainment voltage is being applied, the source driver 1 may have a high output impedance.

As is illustrated above, the output impedance of the source driver 1 needs to be low in some cases and may be high in other cases even when an image is being displayed. Therefore, it is preferred if the source driver 1 can switch between a low output impedance state and a high output impedance state. A switch circuit 41 is provided to each buffer circuit 12, 13 in the present embodiment to enable the source driver 1 to switch the output impedance state.

A switching function of the switch circuit 41 between output impedance states are described in the following.

Referring to FIG. 6, when the switch circuits 41 conduct, the D/A converter circuit 8 receives two groups of currents: one through the buffer circuits 12, 13 and another through the resistors $R_0$–$R_7$.

The output of the buffer circuit 12, 13 is fed back to the input of the buffer circuit 12, 13 through the associated switch circuit 41. In other words, the buffer circuits 12, 13 are used as voltage followers and are capable of supplying large current in a low output impedance state.

Therefore, the current supply to the D/A converter circuit 8 is mainly made up of the current passing through the buffer circuits 12, 13. In other words, the output impedance of the standard voltage generator circuit 7 in relation to the D/A converter circuit 8 is low. The output impedance of the source driver 1 thus becomes low.

Meanwhile, when the switch circuit 41 does not conduct, no current flows through the buffer circuits 12, 13, which means that the current supply to the D/A converter circuit 8 is mainly made up of the current passing through the resistors $R_0$–$R_7$. The resistors $R_0$–$R_7$ here have high resistances to reduce power consumption.

In other words, the output impedance of the standard voltage generator circuit 7 in relation to the D/A converter circuit 8 is high. This output impedance of the source driver 1 thus becomes high.

Now, the following will describe timings to switch the source driver 1 between a high output impedance state and a low output impedance state.

Figure 8:
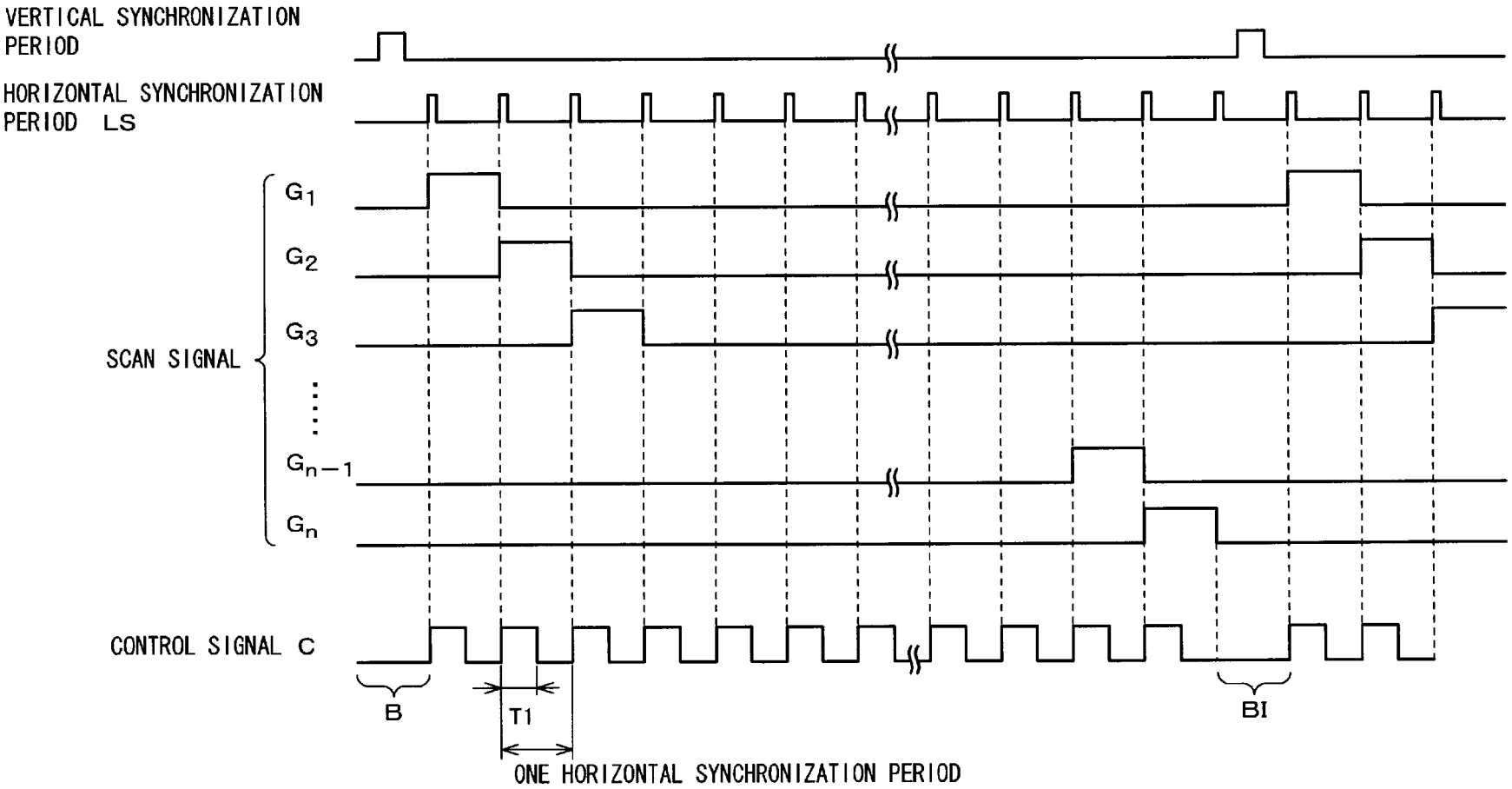
FIG. 8 is a timing chart showing timings to switch the source driver between a high impedance state and a low impedance state.
Figure 9:
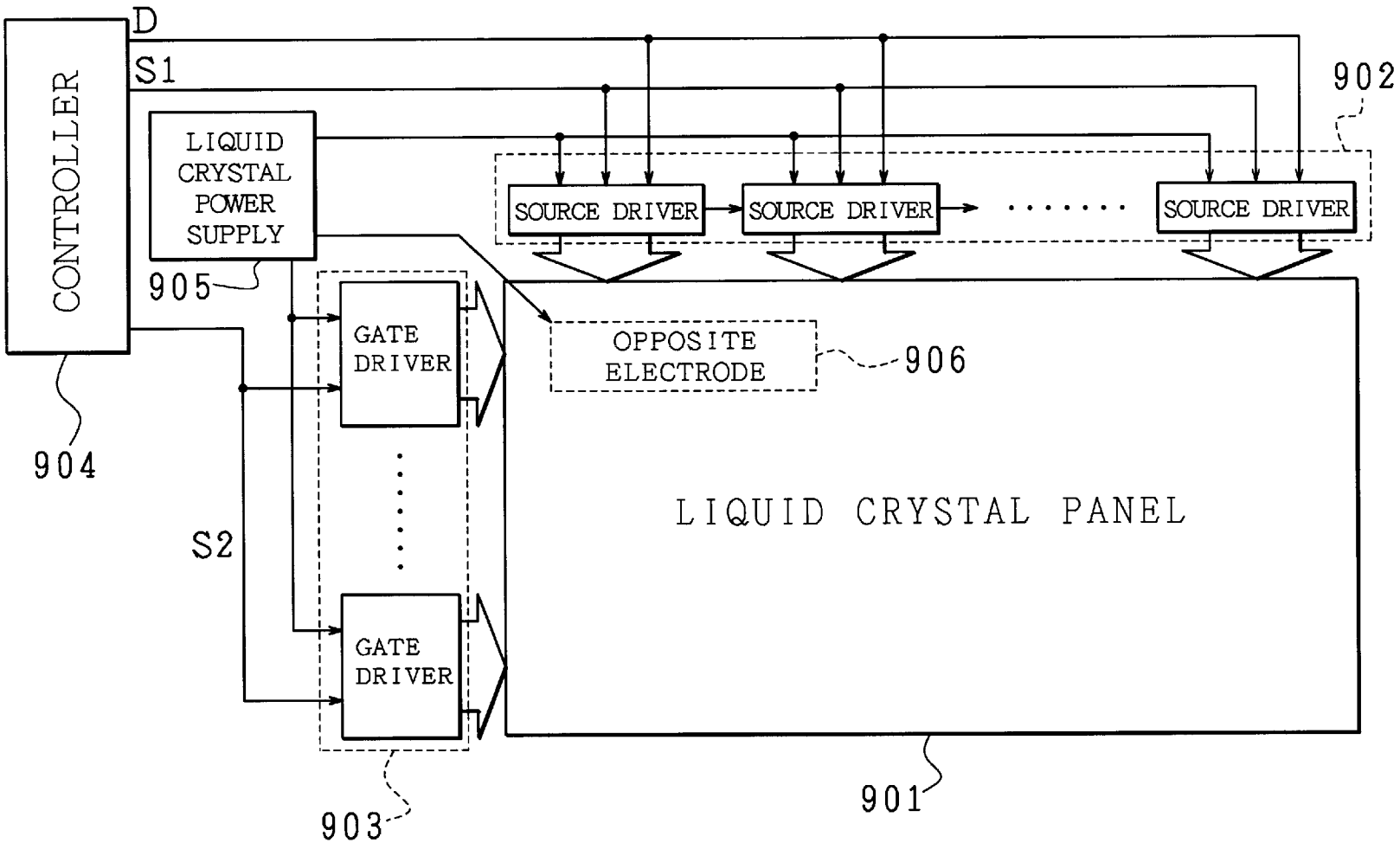
FIG. 9 is a block diagram depicting a schematic structure of a liquid crystal display including at least a liquid crystal driver and a liquid crystal panel.
Figure 10:
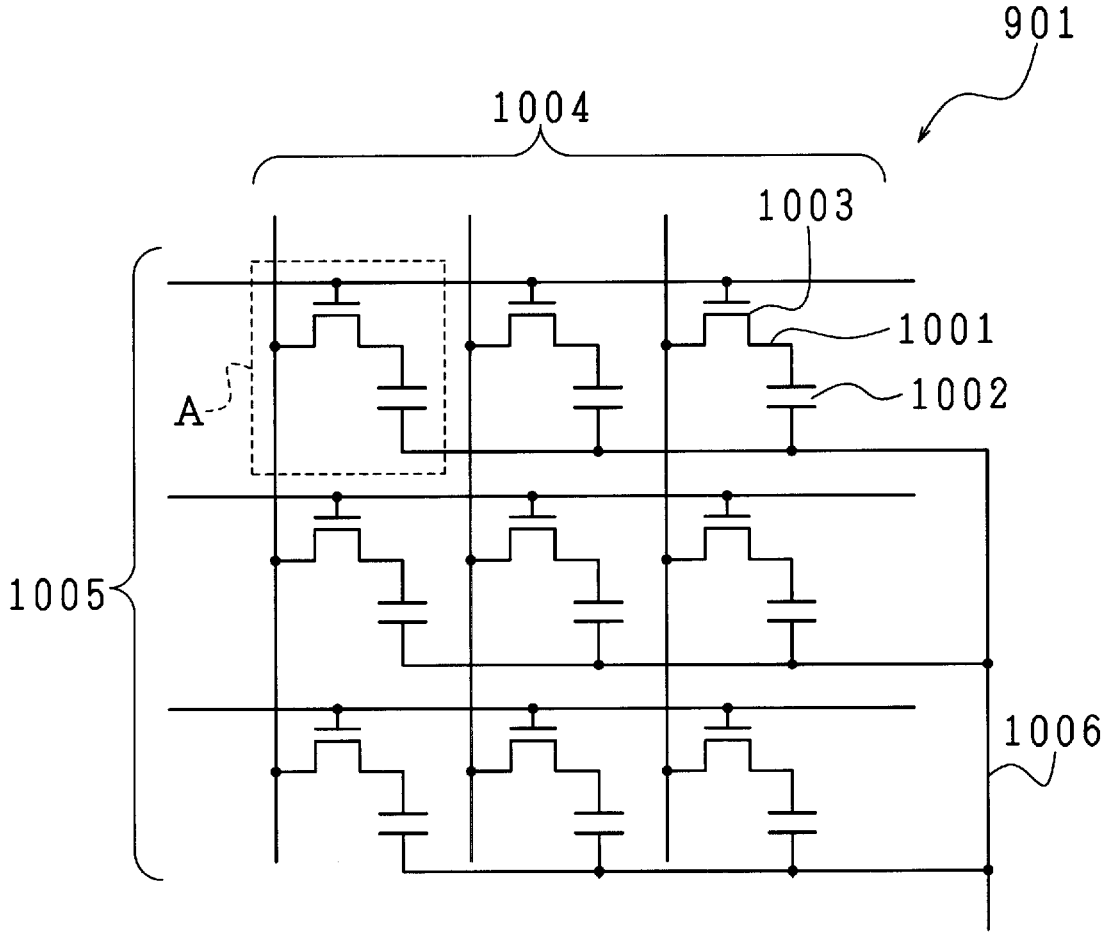
FIG. 10 is a circuit diagram depicting a schematic structure of the liquid crystal panel.
Figure 11:
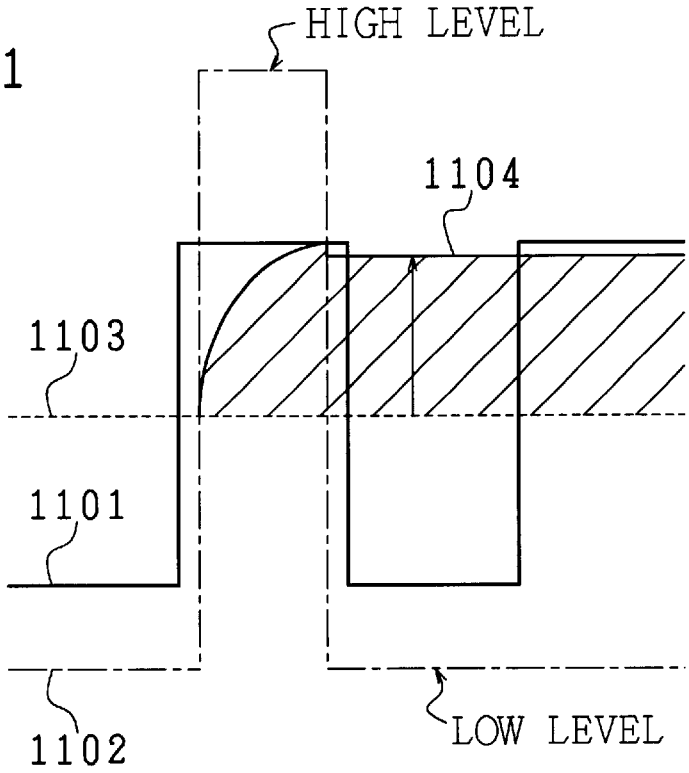
FIG. 11 is a drawing showing an example of a liquid crystal drive waveform for the liquid crystal display.
Figure 12:
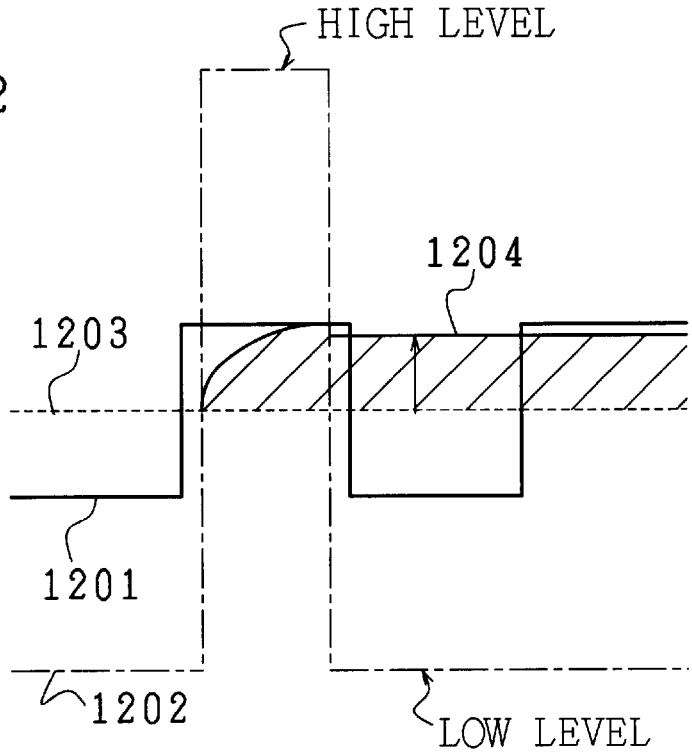
FIG. 12 is a drawing showing another example of a liquid crystal drive waveform for the liquid crystal display.
Figure 13:
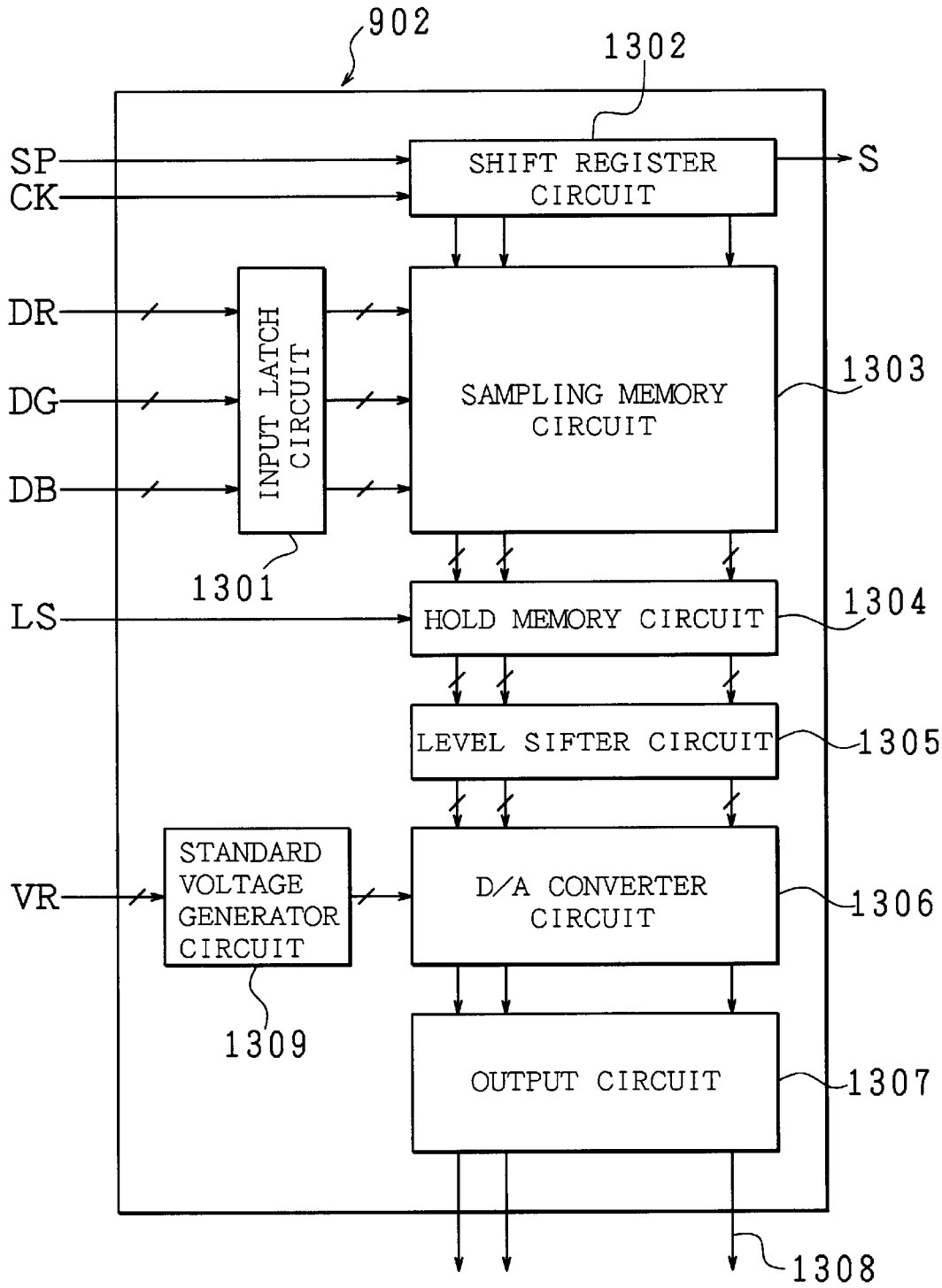
FIG. 13 is a block diagram depicting a schematic structure of a conventional source driver.

As shown in FIG. 8, for a predetermined time of TI after the input of a synchronizing signal LS, the control signal C (t1) is HIGH, activating the buffer circuits 12, 13 and causing the switch circuit 41 to conduct. The outputs from the buffer circuits 12, 13 are thereby supplied to the D/A converter circuit 8.

Consequently, the output from the source driver 1 is in a low output impedance state for a predetermined time of TI following the input of the synchronizing signal LS.

Meanwhile, after the predetermined time of TI elapses and the charging/discharging of the pixel capacitor is completed, the control signal C (t1) drops to a LOW level.

This deactivates the buffer circuits 12, 13 and causes the switch circuit 41 to not conduct. Consequently, the output of the source driver 1 in a high output impedance state.

In this situation, as mentioned above, since $R_{11}$:$R_{12}$= $R_1$:$R_2$ (=1:1 in this case), the deactivation of the buffer circuits 12, 13 does not affect the levels of the tone display voltages $V_0$–$V_{63}$. In FIG. 8, period BI in the timing chart for the control signal C indicates that the buffer circuits 12, 13 are deactivated during a vertical synchronization blanking period.

The description above is based on an assumption that the control signal C is identical to the control signal t1. However, the two signals may be different and alternate between HIGH and LOW at different timings. The use of such two different signals eradicates switching noise that occurs in the output stage of the buffer circuits 12, 13 when the buffer circuits 12, 13 are activated and deactivated.

In this manner, in the source driver 1 of the present embodiment, the outputs of the buffer circuits 12, 13 are fed back to the inputs to the buffer circuits 12, 13.

Therefore the outputs of the buffer circuits 12, 13 are in a low output impedance state, and even if a large surge current occurs, for example, immediately after the liquid crystal panel is powered on, the tone display voltages $V_0$–$V_{63}$ can come to a steady state more quickly, and a good quality image can be displayed.

Further, the ratio of the two resistors ($R_{11}$:$R_{12}$) interposed between two adjacent first reference voltages $V'_{56}$, $V'_{40}$ in the generation circuit 11 to produce the second reference voltage is equal to the ratio of the two resistors ($R_1$:$R_2$) interposed between the two first reference voltages $V'_{56}$, $V'_{40}$ in the resistance divider circuit 14.

In other words, the partial voltage level produced by the generation circuit 11 and fed to the buffer circuit 12 is always equal to the voltage level supplied from the buffer circuit 12 to the resistance divider circuit 14.

In other words, even if such control is done that no operating current flows in the buffer circuit 12, the second reference voltage is still retainable. Therefore, even if no internal current flows in the buffer circuit 12, the display quality of the liquid crystal panel can be maintained.

Further, even in a case when the operating current again flows in the buffer circuit, since the output of the buffer circuit 12 is fed back to the input of the buffer circuit 12, the tone display voltages $V_0$–$V_{63}$ can come to a steady state more quickly.

Accordingly, even if the buffer circuit 12 is supplied with no operating current or conducts while an image display is being produced on the liquid crystal panel, effect on the quality of the image display on the liquid crystal panel is reduced.

On account of this, while a display is being produced on the liquid crystal panel, waste of electric power is again preventable and power consumption is further reduced when the buffer circuit 12 is not required to operate.

The source driver 1 includes: the switch circuits 41 passing or blocking the outputs from the buffer circuits 12, 13; and branch lines connecting the inputs of the buffer circuits 12, 13 to the outputs of the switch circuit 41.

In other words, when the switch circuit 41 conducts, the outputs of the buffer circuits 12, 13 are in a low output impedance state.

On account of this, even if a large surge current occurs, for example, immediately after the liquid crystal panel is powered on, the tone display voltages $V_0$–$V_{63}$ can come to a steady state more quickly, and a good quality image can be displayed.

Meanwhile, while the switch circuit 41 is blocking the output from the buffer circuits 12, 13, the second reference voltage produced by the generation circuit 11 flows to the resistance divider circuit 14 through the path connecting the inputs of the buffer circuits 12, 13 to the output of the switch circuit 41.

On account of this, for example, after the display by the liquid crystal panel comes to a steady state, even if the internal currents of the buffer circuits 12, 13 are blocked, the display quality of the liquid crystal panel can be maintained.

On account of this, while a display is being produced on the liquid crystal panel, waste of electric power is again preventable and power consumption is further reduced when the buffer circuit 12 is not required to operate.

Moreover, in the source driver 1, the control signal C for the operating currents in the buffer circuits 12, 13 is identical to the control signal ti for the switch circuits 41.

On account of this, the input terminal of the source driver 1 can be shared between the two control signals C, t1, reducing the total number of terminals.

Further, in the source driver 1, the operating currents in the buffer circuits 12, 13 are blocked when a predetermined time TI elapses after the second reference voltage is received.

In other words, the operating currents in the buffer circuits 12, 13 are more frequently blocked while a display is being produced on the liquid crystal panel. On account of this, the power consumption in the source driver 1 is further reduced.

Japanese Laid-Open Patent Application No. 2000-47625 (Tokukai 2000-47625; published on Feb. 18, 2000) and other publications disclose a structure to supply the output of a selective circuit directly to a liquid crystal panel without going through a buffer circuit. The conventional structure is the same as the structure of the present invention in that both are intended to reduce the buffer circuits in number which are conventionally provided so that each output terminal has one buffer circuit. However, the structure disclosed in the Japanese Laid-Open Patent Application includes buffer circuits in a subsequent stage of a resistance divider circuit (bias voltage generator section) for generating a plurality of bias voltages, whereas the structure of the present invention includes buffer circuits 12, 13 in a preceding stage of the resistance divider circuit 14. The two structures are clearly different.

Suppose that buffer circuits are provided in a subsequent stage of a resistance divider circuit as in the Japanese Laid-Open Patent Application, the same number of buffer circuits as the tone display voltages need to be provided to use the buffer circuits in reducing distortion in waveforms of the tone display voltage outputs from the resistance divider circuit.

By contrast, in the present invention, for example, the resistor $R_2$ in the resistance divider circuit 14 derives tone display voltages $V_{41}$–$V_{48}$ from the second reference voltage supplied from the buffer circuit 12. Under these circumstances, the buffer circuit 12 reduces distortion in the waveform of the second reference voltage. This can be interpreted to mean that the single buffer circuit 12 is capable of reducing distortion in the waveforms of the tone display voltages $V_{41}$–$V_{48}$, because these tone display voltages are obtained from the second reference voltage. In other words, in the present invention, since the buffer circuit 12 is located in the preceding stage of the resistance divider circuit 14, there is no need to provide the same number of buffer circuits 12 as the tone display voltages $V_{41}$–$V_{48}$.

Therefore, for the same number of derived tone display voltages, the present invention significantly reduces the number of buffer circuits provided in the standard voltage generator circuit 7 and ensures effects of the miniaturization of the device and the reduction in power consumption of the device, compared to the Japanese Laid-Open Patent Application.

Incidentally, a liquid crystal driver in accordance with the present invention may include: voltage dividing means formed by a first resistance divider circuit in which resistors are connected in series correspondingly between adjacent first reference voltages and adjacent first and second reference voltages; and generation means formed by a second resistance divider circuit in which resistors are connected in series correspondingly with adjacent first and second reference voltages, wherein the resistors constituting the first resistance divider circuit and those constituting the second resistance divider circuit are specified to have such a resistance ratio that gamma correction can be implemented on $2^n$ tone display voltage by each group of resistors to produce a naturally looking tone display.

According to the arrangement, the resistors constituting the first resistance divider circuit in the voltage dividing means and those constituting the second resistance divider circuit in the generation means are specified to have such a resistance ratio that gamma correction can be implemented by each group of resistors. The gamma correction implemented by both the first resistance divider circuit and the second resistance divider circuit ensures that a tone display that look natural to the human eye is produced from the $2^n$ tone display voltage produced by the first resistance divider circuit.

In a liquid crystal driver in accordance with the present invention, the generation means may be adapted so as to produce a voltage other than those equal to a maximum or a minimum in an input range of the first reference voltages as the second reference voltage.

It is ensured that the maximum and minimum in the input range of the first reference voltages are supplied to the standard voltage producing means; however, other voltages in the input range are in some cases not supplied to standard voltage producing means, because they are used fine adjustment.

In the foregoing structure, the generation means produces a voltage other than those equal to the maximum or minimum as the second reference voltage; therefore, it is ensured that the voltage dividing means can produce the $2^n$ tone display voltages from remaining ones of the incoming first reference voltages and the second reference voltages produced by the generation means even when no voltage is supplied to the standard voltage producing means other than the maximum and minimum in the input range of the first reference voltages.

In a liquid crystal driver in accordance with the present invention, the buffer means may include control means for controlling an operating current in the buffer means in accordance with an externally provided control signal.

In this structure, the control means controls the operating current in accordance with an externally provided control signal so that, for example, the operating current flows in the buffer means when the buffer means needs to be activated and dose not low in the buffer means when the buffer means needs to be deactivated. This ensures electric power is not wasted when the buffer means does not need to operate, and reduction in power consumption by the buffer means is surely achieved.

A liquid crystal driver in accordance with the present invention may further include switch means for passing or blocking an output from the buffer means, wherein there is provided a branch line connecting an input of the buffer means to an output of the switch means.

In this structure, when the switch means conducts, the output of the buffer means is fed back to the buffer means via the switch means. In other words, the buffer means acts as a voltage follower, and the output of the buffer means is therefore in a low output impedance state.

On account of this, even if a large surge current occurs, for example, immediately after the liquid crystal panel is powered on, the tone display voltages can come to a steady state more quickly, and a good quality image can be displayed.

Meanwhile, while the switch means is blocking the output from the buffer means, the second reference voltage produced by the generation circuit flows to the voltage dividing means through the path connecting the input of the buffer means to the output of the switch means.

On account of this, for example, after the display by the liquid crystal panel comes to a steady state, even if the internal operating current of the buffer means are blocked by the control, the second reference voltage can be maintained. In other words, blocking the current in the buffer means, the quality of a displayed image on a liquid crystal panel can be maintained.

On account of this, while a display is being produced on the liquid crystal panel, waste of electric power is again preventable and power consumption is further reduced when the buffer means is not required to operate.

Moreover, in a liquid crystal driver in accordance with the present invention, the control signal for the operating current in the buffer means may be identical to a control signal for the switch means.

According to the arrangement, the control signal for the operating current in the buffer means may be identical to a control signal for the switch means.

On account of this, the input terminal of the liquid crystal driver can be shared between the two control signals, reducing the total number of terminals.

Further, in a liquid crystal driver in accordance with the present invention, the operating current in the buffer means may be blocked when a predetermined time elapses after the second reference voltage is received.

According to the arrangement, the operating current in the buffer means is blocked when a predetermined time elapses after the second reference voltage is received.

In other words, the operating current in the buffer means are more frequently blocked while a display is being produced on the liquid crystal panel. On account of this, the power consumption in the liquid crystal driver is further reduced.

In a liquid crystal driver in accordance with the present invention, an output of the buffer means may be fed back to an input of the buffer means.

According to the arrangement, an output of the buffer means is fed back to an input of the buffer means. In other words, the buffer means acts as a voltage follower, and the output of the buffer means is therefore in a low output impedance state.

On account of this, even if a large surge current occurs, for example, immediately after the liquid crystal panel is powered on, the tone display voltage can come to a steady state more quickly, and a good quality image can be displayed.

In a liquid crystal driver in accordance with the present invention, a ratio of two resistors provided between two adjacent first reference voltages in the generation means to produce the second reference voltage may be equal to a ratio of two resistors provided between the two adjacent first reference voltages in the voltage dividing means.

According to the arrangement, the partial voltage level produced by the generation means by voltage division and fed to the buffer means is always equal to the voltage level supplied from the buffer means to the voltage dividing means.

In other words, even if such control is done that no operating current flows in the buffer means, the second reference voltage is still retainable. Therefore, even if no internal current flows in the buffer means, the display quality of the liquid crystal panel can be maintained.

Further, even in a case when the operating current again flows in the buffer means, since the output of the buffer means is fed back to the input of the buffer means, the tone display voltages can come to a steady state more quickly.

Accordingly, even if the buffer means is supplied with no operating current or conducts while an image display is being produced on the liquid crystal panel, effect on the quality of the image display on the liquid crystal panel is reduced.

On account of this, while a display is being produced on the liquid crystal panel, waste of electric power is again preventable and power consumption is further reduced when the buffer means is not required to operate.

In a liquid crystal driver in accordance with the present invention, the standard voltage producing means may further include input terminals to which the first reference voltages are applied; and no input terminals may be provided for receiving the first reference voltages that correspond to the second reference voltage produced by the generation means.

According to the arrangement, no input terminals are provided for the first reference voltages that correspond to the second reference voltages; therefore, for example, the number of wires required in the supply of the first reference voltages from the liquid crystal power supply to the liquid crystal driver is reduced. On account of this, the liquid crystal driver, and hence the liquid crystal display including the liquid crystal driver, can be reduced in size.

The liquid crystal drivers in accordance with the present invention detailed so far can be alternatively defined as the following first to eighth liquid crystal drivers.

A first liquid crystal driver includes: standard voltage producing means for producing $2^n$ gamma-correction-compatible voltages from incoming reference voltages by the voltage division of adjacent ones of the incoming reference voltages, for output of tone display voltages in accordance with incoming n-bit display data; and selecting means for selecting a voltage from the $2^n$ voltages in accordance with the display data, an output from the selecting means being transmitted with no further processing as a tone display voltage for a liquid crystal display, wherein the standard voltage producing means includes: generation means for internally generating some of the reference voltages from adjacently upper and lower reference voltages; and buffer means for the generated voltages.

In the first liquid crystal driver, a second liquid crystal driver is such that: the standard voltage producing means includes generating means (resistance divider circuit) for obtaining the $2^n$ voltages from intervals between gamma-correction-compatible resistor elements connected in series; the generation means is formed by a resistance divider circuit for obtaining voltages from intervals between gamma-correction-compatible resistor elements connected in series between adjacent upper and lower ones of the internally generated reference voltages, and the voltages obtained with the generation means are supplied via a buffer means to predetermined intervals between the resistors in the generating means for generating the $2^n$ voltages.

In the first or second liquid crystal driver, a third liquid crystal driver is such that the generation means produces a voltage having a level either equal or close to a mid-level of the incoming reference voltages from adjacent upper and lower reference voltages.

In any one of the first to third liquid crystal drivers, a fourth liquid crystal driver is such that the buffer means includes switching means (control means) for creating high output impedance and cutting off an internal operating current by an externally provided switching signal when not in operation.

In the fourth liquid crystal driver, a fifth liquid crystal driver is such that: the buffer means further includes at an output switch means controlled by an external on/off control signal; and an output of the switch means is connected to an input of the buffer means.

In the fifth liquid crystal driver, a sixth liquid crystal driver is such that the buffer means operates in an initial state for a predetermined time after a voltage is selected for output in accordance with the display data.

In the fifth or sixth liquid crystal driver, a seventh liquid crystal driver is such that the control signal for the buffer means is identical to the control signal for the switch means.

In any one of the first to seventh liquid crystal drivers, the eighth liquid crystal driver is such that among the reference voltages supplied to the standard voltage producing means, those reference voltages that correspond to the voltages produced by the generation mean are omitted.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A liquid crystal driver, comprising: standard voltage producing means for producing $2^n$ tone display voltages from incoming first reference voltages in accordance with n-bit display data; and selecting means for selecting a voltage from the $2^n$ tone display voltages in accordance with incoming display data, for transmission to a liquid crystal panel through a plurality of output terminals with no further processing, wherein the standard voltage producing means includes:

generation means for generating a second reference voltage from adjacent two of the first reference voltages arranged in ascending or descending order, the second reference voltage having an intermediate level between those of the adjacent first reference voltages;

buffer means for impedance-converting the second reference voltage for output; and voltage dividing means for producing a voltage having an intermediate level between those of the adjacent first reference voltages and of adjacent ones of the first and second reference voltages by voltage division, so as to produce the $2^n$ tone display voltages.

2. The liquid crystal driver as set forth in claim 1, wherein:

the voltage dividing means includes a first resistance divider circuit composed of resistors provided in series correspondingly between the adjacent first reference voltages and between the adjacent first and second reference voltages;

the generation means includes a second resistance divider circuit composed of resistors provided in series correspondingly between the adjacent first and second reference voltages; and the resistors composing the first resistance divider circuit and the resistors composing the second resistance divider circuit are specified to have respective such ratios of resistances that a gamma correction can be implemented on the $2^n$ tone display voltages to produce a naturally looking tone display.

3. The liquid crystal driver as set forth in claim 1, wherein:

the generation means can produce a voltage other than those equal to a maximum or a minimum in an input range of the first reference voltages as the second reference voltage.

4. The liquid crystal driver as set forth in claim 1, wherein:

the buffer means includes control means for controlling an operating current in the buffer means in accordance with an externally provided control signal.

5. The liquid crystal driver as set forth in claim 4, further comprising switch means for passing or blocking an output from the buffer means, wherein there is provided a branch line connecting an input of the buffer means to an output of the switch means.

6. The liquid crystal driver as set forth in claim 5, where in the control signal for the operating current in the buffer means is identical to a control signal for the switch means.

7. The liquid crystal driver as set forth in claim 5, wherein the operating current in the buffer means is blocked when a predetermined time elapses after the second reference voltage is received.

8. The liquid crystal driver as set forth in claim 1, wherein an output of the buffer means is fed back to an input of the buffer means.

9. The liquid crystal driver as set forth in claim 8, wherein a ratio of two resistors provided between two adjacent first reference voltages in the generation means to produce the second reference voltage is equal to a ratio of two resistors provided between the two adjacent first reference voltages in the voltage dividing means.

10. The liquid crystal driver as set forth in claim 8, wherein an operating current in the buffer means is blocked when a predetermined time elapses after the second reference voltage is received.

11. The liquid crystal driver as set forth in claim 1, wherein:

the standard voltage producing means further includes input terminals to which the first reference voltages are applied; and no input terminals are provided for receiving the first reference voltages that correspond to the second reference voltage produced by the generation means.

12. A liquid crystal display, comprising:

the liquid crystal driver as set forth in claim 1; and a liquid crystal panel driven by the liquid crystal driver.

* * * * *